US006415127B1

(12) United States Patent
Yamamoto et al.

(10) Patent No.: US 6,415,127 B1
(45) Date of Patent: Jul. 2, 2002

(54) DEVELOPING APPARATUS HAVING A DIRECT OR ALTERNATING CURRENT APPLIED THERETO

(75) Inventors: Shinya Yamamoto; Hiroshi Sasame; Tetsuya Kobayashi, all of Numazu; Kouji Hashimoto; Yasunari Watanabe, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/569,236

(22) Filed: May 11, 2000

(30) Foreign Application Priority Data

May 14, 1999 (JP) ..... 11-133965

(51) Int. Cl.[7] ..... G03G 15/08
(52) U.S. Cl. ..... 399/284; 399/111; 399/285
(58) Field of Search ..... 399/284, 285, 399/302, 111

(56) References Cited

U.S. PATENT DOCUMENTS

| | | | | |
|---|---|---|---|---|
| 4,626,487 A | | 12/1986 | Mitsuhashi et al. | 430/109 |
| 4,887,102 A | | 12/1989 | Yoshikawa et al. | 346/157 |
| RE34,724 E | | 9/1994 | Hosono et al. | 118/657 |
| 5,592,266 A | * | 1/1997 | Park et al. | 399/284 |
| 5,678,130 A | | 10/1997 | Enomoto et al. | 399/55 |
| 5,701,568 A | * | 12/1997 | Hiroshima et al. | 399/302 |
| 5,761,590 A | * | 6/1998 | Sato | 399/285 |
| 5,970,280 A | * | 10/1999 | Suzuki et al. | 399/285 X |
| 6,064,463 A | * | 5/2000 | Yamada et al. | 399/284 X |
| 6,115,575 A | | 9/2000 | Kinoshita et al. | 399/286 |
| 6,154,623 A | * | 11/2000 | Suzuki et al. | 399/111 |
| 6,154,627 A | * | 11/2000 | Iwamatsu et al. | 399/284 X |
| 6,163,663 A | * | 12/2000 | Shinohara et al. | 399/285 X |

FOREIGN PATENT DOCUMENTS

| | | |
|---|---|---|
| JP | 54-43038 | 4/1979 |
| JP | 60-32060 | 2/1985 |

* cited by examiner

*Primary Examiner*—Fred L. Braun
(74) *Attorney, Agent, or Firm*—Fitzpatrick, Cella, Harper & Scinto

(57) ABSTRACT

A developing apparatus has a developer bearing member for bearing and carrying a nonmagnetic developer, a layer thickness regulating member for regulating a layer thickness of the developer borne by the developer bearing member, developing bias applying device for applying an alternating current voltage to the developer bearing member, and regulating member bias applying device for applying a direct current voltage to the layer thickness regulating member, and wherein |DC1|>|DC2| is satisfied when DC1 is an effective value of the alternating current voltage applied to the developer bearing member and DC2 is a value of the direct current voltage applied to the layer thickness regulating member, the direct current voltage value DC2 has a polarity, which is reverse to a charging polarity of the developer with respect to the effective value DC1.

17 Claims, 13 Drawing Sheets

DEVELOPING APPARATUS HAVING A DIRECT OR ALTERNATING CURRENT APPLIED THERETO

BACKGROUND OF THE INVENTION

1. Field of the Invention

The present invention relates to a developing apparatus used in an image forming apparatus such as an electrophotographic copying machine and an electrophotographic printer.

2. Related Background Art

In the image forming apparatus of an electrophotographic system, an electrostatic latent image formed on an image bearing member is developed by a developing apparatus and is visualized as a toner image. In an image forming apparatus for forming a color image by overlapping toner images of plural colors, an image forming apparatus using an intermediate transfer member as shown in FIG. 15 is proposed and practically used to form a color image having no color shift. In this image forming apparatus, the image can be formed by using the intermediate transfer member irrespective of sizes and thicknesses of a transfer member, etc. and media flexibility is also improved.

An image forming process in the image forming apparatus in FIG. 15 will be explained. The image forming apparatus is connected to a host device 112 such as a personal computer and a work station, and receives image data through a video interface by a print request from the host device 112. These image data are decomposed into four colors of yellow, magenta, cyan and black, and charge, exposure and development processes are sequentially performed in each color with respect to a photosensitive drum 110 so that toner images are formed. These toner images are overlapped and transferred to the intermediate transfer member (intermediate transfer drum) 105 of a drum shape. Thereafter, these toner images are transferred together to a recording material such as paper as a recording medium so that a full color image is formed on the recording material.

The photosensitive drum 110 as a first image bearing member is rotated at a predetermined circumferential speed in an arrow direction. A surface of this photosensitive drum 110 is uniformly charged by a charging roller 102 as a charging means. The charging roller 102 comes in press contact with the surface of the photosensitive drum 110 with predetermined pressing force, and charges the photosensitive drum 110 while the charging roller 102 is driven and rotated by the rotation of the photosensitive drum 110. Next, a scanning operation is performed by an exposure means 103 on/off-controlled in accordance with image data of a first color (e.g., yellow), and an electrostatic latent image of the first color is formed on the surface of the photosensitive drum 110. This electrostatic latent image of the first color is developed by a developing apparatus 104Y storing yellow toner among plural developing apparatuses 104 and is visualized as a yellow toner image. The developing apparatuses 104 (104Y to 104K) will be described later.

The toner image of the first color formed on the photosensitive drum 110 is transferred to a surface of the intermediate transfer drum 105 (primary transfer). The intermediate transfer drum 105 as a second image bearing member comes in press in contact with the photosensitive drum 110 with constant pressing force, and is rotated in an arrow direction in FIG. 15 at a circumferential speed approximately equal to that of the photosensitive drum 110. The toner untransferred but left on the surface of the photosensitive drum 110 in the primary transfer is scraped by a cleaning blade 106*a* of a cleaner 106 coming in press contact with the photosensitive drum 110 and is stored into a waste toner container 106*b*.

The above processes are also repeated with respect to magenta, cyan and black. Every time a magenta toner image of a second color, a cyan toner image of a third color and a black toner image of a fourth color are obtained, the toner images are sequentially transferred onto the intermediate transfer drum 105. Thus, a full color image obtained by overlapping the toner images of the four colors is formed on the intermediate transfer drum 105.

The full color image on the intermediate transfer drum 105 is electrostatically transferred together to a recording material P fed from a paper cassette 108, etc. by a secondary transfer roller 109 (secondary transfer). Thereafter, the recording material P is sent to a fixing apparatus 107 and the four toner images are fixed. Thereafter, the recording material P is discharged from a discharging portion to the exterior of the apparatus so that a predetermined desirable print image is obtained.

The developing apparatuses 104 (104Y, 104M, 104C, 104K) in the above image forming apparatus are not particularly limited, but dry type one-component developing apparatuses are variously proposed as one of the developing apparatuses and are practically used. This is because the developing apparatus can be generally made compact and simplified in structure by a dry type one-component developing method. However, a problem exists in that it is difficult to form a thin layer of toner as a one-component developer on a developer bearing member in any of the developing apparatuses of the dry type one-component system.

However, developments with respect to thin layer forming method and apparatus of toner are indispensable since improvements of resolution and clearness of the image, etc. are required at present. Therefore, some measures with respect to this problem are proposed.

For example, as shown in Japanese Patent Application Laid-Open No. 54-43038 (1979), a developing blade (an elastic regulating member) made of rubber or a metal abuts on the developer bearing member and toner passes through an abutting portion between this developing blade and the developer bearing member and is regulated. Thus, a toner thin layer is formed on the developer bearing member and sufficient frictional charged charges (triboelectricity) are given to the toner by friction in the abutting portion. This dry type one-component developing apparatus and the thin layer forming method do not limit the toner (one-component toner) as a one-component developer at all.

In the case of magnetic toner, a developing apparatus as shown in FIG. 16 is proposed. In this developing apparatus 104, toner is supplied and borne onto a developing sleeve 121 (developer bearing member) by magnetic force of a magnet 113 of a roller shape arranged within the developing sleeve 121. The toner passes through an abutting portion between the developing sleeve 121 and a developing blade 122 and is regulated so that a toner thin layer is formed on the developing sleeve 121. In the case of nonmagnetic toner, it is necessary to separately arrange a toner supply member for supplying the toner onto the developing sleeve. This is because no nonmagnetic toner is supplied by magnetic force.

Therefore, a developing apparatus as shown in FIG. 17 is proposed as the developing apparatus using nonmagnetic toner. In this developing apparatus 104, a toner supply roller 123 is arranged in a position of a developing sleeve 121 on its upstream side from a developing blade 122 in a rotating direction of this developing sleeve 121 within a developing container 126 storing nonmagnetic toner T as a one-component developer. The toner supply roller 123 is constructed by using a foam body formed by polyurethane foam, sponge, etc., or a fur brush abutting on the developing sleeve 121. The toner T is supplied and borne onto the developing sleeve 121 by rotating this toner supply roller 123 in an arrow direction.

The toner borne onto the developing sleeve 121 is sent to an abutting portion of the developing sleeve 121 and the developing blade 122 as the developing sleeve 121 is rotated. The toner is regulated and formed as a thin layer in this abutting portion. Thereafter, the toner is carried to a developing portion opposed to the photosensitive drum 110 and is used to develop an electrostatic latent image on the photosensitive drum. The toner unconsumed in the development but left on the developing sleeve 121 is returned to the interior of the developing container 126 as the developing sleeve 121 is rotated. This toner is then scraped by the supply roller 123. Simultaneously, as mentioned above, new toner is supplied onto the developing sleeve 121 by the supply roller 123.

When the developing sleeve 121 is manufactured by a metallic material, it is not preferable to use a metallic thin plate as the developing blade 122 in view of wearing of the developing sleeve 121. It is necessary to use a rubber material such as urethane, silicon on an abutting face of the developing blade 122 on the developing sleeve 121 so as to obtain a preferable toner thin layer. When the developing sleeve 121 is manufactured by a rubber material such as urethane, silicon, each of a metallic thin plate and a rubber material such as urethane and silicon can be used in the developing blade 122.

Improvements of resolution and clearness of an image, etc. are similarly required in the toner of a one-component developer used in the above developing apparatus 104.

With respect to the improvement of a transfer property of the toner, it has been found that transfer efficiency can be greatly improved as an acting effect of a toner shape by forming the toner in a spherical shape in comparison with the toner of an undefined shape manufactured by a conventional grinding method. There are mainly the following two methods as a method for manufacturing the spherical toner.

(1) Plastic spherical processing of a surface of the conventional grinding toner is performed by thermal stress and mechanical stress. (2) The spherical toner is manufactured by a polymerizing method.

Further, in the above methods, attachment and dissociation of externally-added fine powder with respect to the toner are repeated by a shearing force applied to the externally-added fine powder within the developing container. Therefore, the number of contact times of the fine powder and the toner is increased so that frictional charged charges of the toner can be increased and a developing property of the toner can be improved.

For example, as shown in Japanese Patent Application Laid-Open No. 60-32060 (1985), a polishing agent component can be externally added to the toner with respect to phenomena of filming and toner melting attachment in which the toner left on the photosensitive drum is strongly fixed and deposited by a cleaning blade and a charging roller coming in press contact with the photosensitive drum at a predetermined pressure. It is possible to prevent the toner left on the photosensitive drum from being strongly fixed and deposited in advance by suitably polishing the surface of the photosensitive drum by the polishing agent component.

However, when a developing operation is performed by using one-component nonmagnetic toner T is used in the above developing apparatus 104, the toner ununiformly stays in a longitudinal direction of the developing sleeve 121 in the vicinity of an abutting nip portion of the developing blade 122 and the developing sleeve 121 so that an image defect (poor image) is caused. Further, when the developing operation is repeated many times, a staying toner amount becomes excessive so that the toner drops from the developing apparatus. Therefore, an image defect is caused and no developing apparatus can be used.

As shown in FIG. 18, the toner accumulating in a portion of the abutting portion of the developing sleeve 121 and the developing blade 122 on its downstream side in the rotating direction of the developing sleeve, i.e., in a wedge-shaped portion A. The accumulating toner is gradually grown in the wedge-shaped portion A by rotating the developing sleeve 121 at a time of the developing operation and finally becomes a cohering lump of the toner. This cohering lump drops from the wedge-shaped portion A as the developing sleeve 121 is rotated, thereby causing an image defect.

At this time, it has been found that cohering degrees of the toner staying in the wedge-shaped portion A and the toner within the developing container 126 are increased and the cohering lump is easily caused in the toner of a high cohering degree.

This phenomenon is notable when fine powder of a positive charging property and fine powder of a weak charging property charged in a polarity reverse to that of the toner are externally added as an external additive to the toner of a negative charging property to improve the transfer property and the developing property. Further, this phenomenon is also notable when a polishing agent component for preventing filming and melting attachment of the toner to the photosensitive drum, etc. is externally added to the toner.

When the above-mentioned magnetic toner is used, such a problem is not caused. The reasons for this are not clear, but it is considered that this is because the magnetic toner is borne to the developing sleeve in a brush shape, but the nonmagnetic toner is borne to the developing sleeve in a layer shape.

SUMMARY OF THE INVENTION

An object of the present invention is to provide a developing apparatus capable of stably forming a thin layer of nonmagnetic toner on a developer bearing member.

Another object of the present invention is to provide a developing apparatus in which the accumulation of toner in a longitudinal direction is prevented in the vicinity of an abutting portion of a developer bearing member and a developer regulating member and a thin layer of nonmagnetic toner can be stably formed on the developer bearing member, and an image of high quality can be obtained by performing a preferable developing operation.

Another object of the present invention is to provide a developing apparatus in which a thin layer of toner can be stably formed on a developer bearing member even when powder charged in a polarity reverse to that of the toner is externally added to this toner, and an image of high quality can be similarly obtained.

Another object of the present invention is to provide a developing apparatus comprising:

- a developer bearing member for bearing and carrying a nonmagnetic developer;
- a layer thickness regulating member for regulating a layer thickness of the developer borne by the developer bearing member;

developing bias applying means for applying an alternating current voltage to the developer bearing member; and regulating member bias applying means for applying a direct current voltage to the layer thickness regulating member;

wherein when DC1 is an effective value of the alternating current voltage applied to the developer bearing member and DC2 is a value of the direct current voltage applied to the layer thickness regulating member, the direct current voltage value DC2 has a polarity, which is reverse to a charging polarity of the developer with respect to the effective value DC1.

Another object of the present invention is to provide a developing apparatus comprising:

a developer bearing member for bearing and carrying a nonmagnetic developer;

a layer thickness regulating member for regulating a layer thickness of the developer borne by the developer bearing member;

developing bias applying means for applying a direct current voltage to the developer bearing member; and regulating member bias applying means for applying an alternating current voltage to the layer thickness regulating member;

wherein when DC1 is an effective value of the alternating current voltage applied to the developer bearing member and DC2 is a value of the direct current voltage applied to the layer thickness regulating member, the direct current voltage value DC2 has a polarity, which is reverse to a charging polarity of the developer with respect to the effective value DC1.

Another object of the present invention is to provide a developing apparatus detachably attachable to a main body of an image forming apparatus, comprising:

a developing apparatus side contact connected to an apparatus side contact of the main body of the image forming apparatus when the developing apparatus is mounted to the apparatus main body;

a developer bearing member for bearing and carrying a nonmagnetic developer, wherein a bias voltage can be applied to the developer bearing member by connecting the developing apparatus side contact to the apparatus side contact; and a layer thickness regulating member for regulating a layer thickness of the developer borne by the developer bearing member, wherein the bias voltage can be applied to the layer thickness regulating member by connecting the developing apparatus side contact to the apparatus side contact.

The other objects and features of the present invention will become more apparent by reading the following detailed explanation with reference to the accompanying drawings.

DESCRIPTION OF THE PREFERRED EMBODIMENTS

The embodiments of the present invention will next be explained further in detail with reference to the drawings.

Embodiment 1

Figure 1:
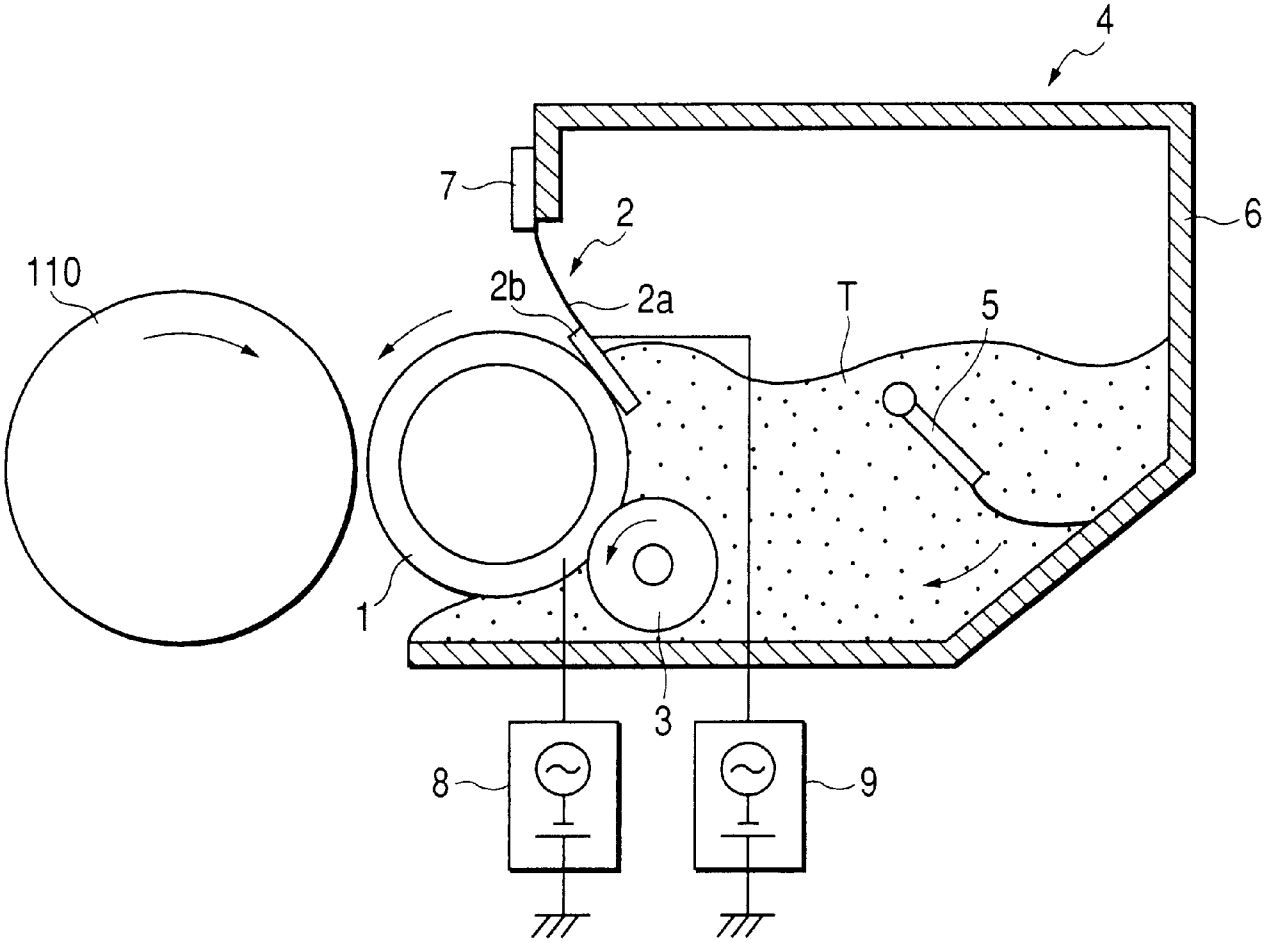
FIG. 1 is a schematic view showing one embodiment of a developing apparatus of the present invention.

FIG. 1 is a schematic structual view showing one embodiment of a developing apparatus of the present invention.

Figure 15:
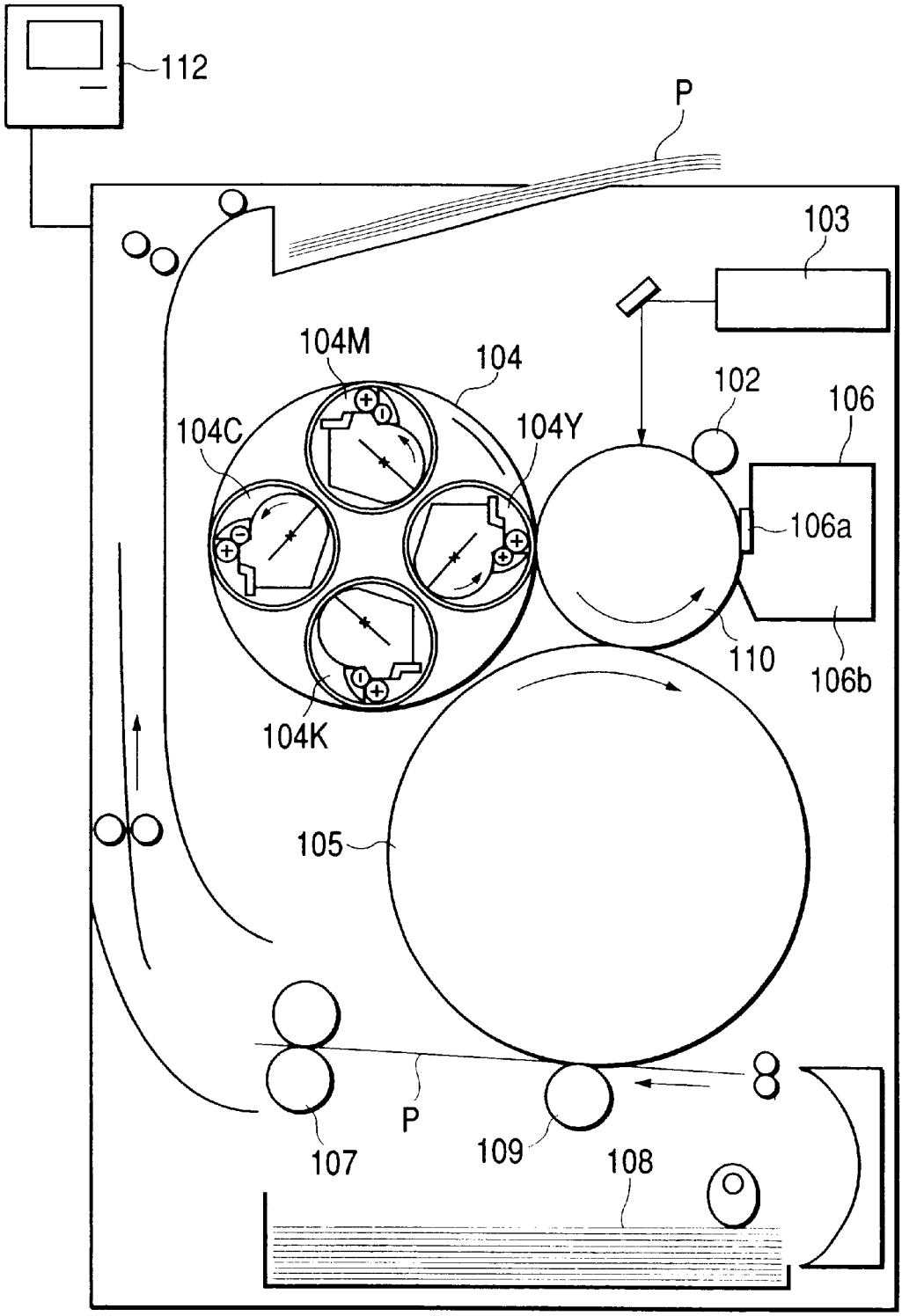
FIG. 15 is a schematic view showing an image forming apparatus using an intermediate transfer member.
Figure 16:
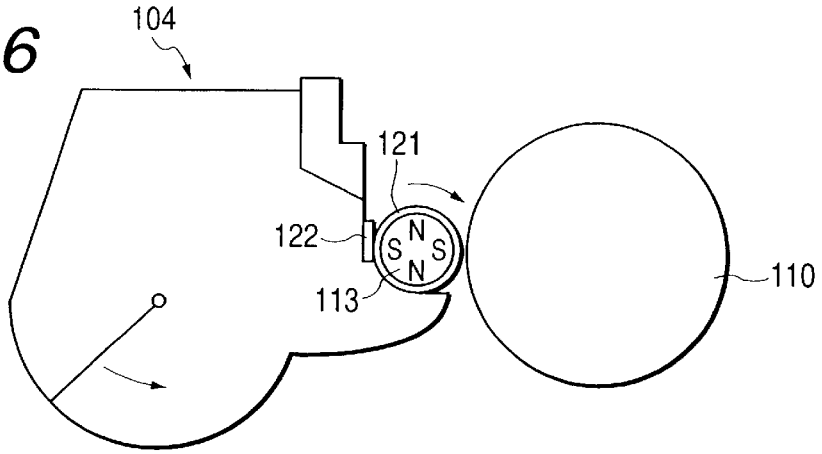
FIG. 16 is a schematic view showing a developing apparatus using conventional magnetic toner.
Figure 17:
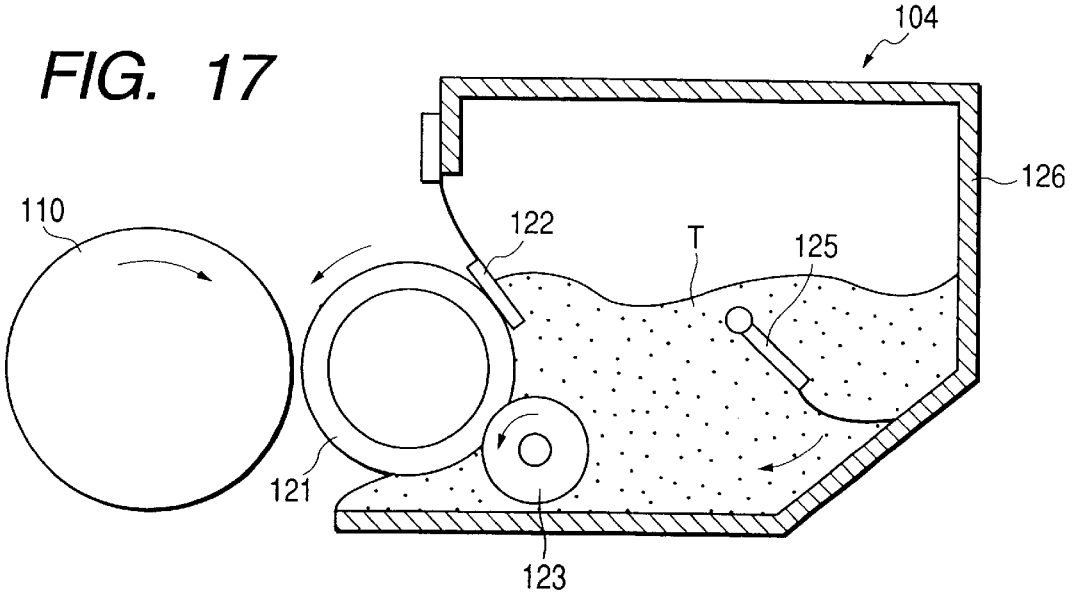
FIG. 17 is a schematic view showing a developing apparatus using conventional nonmagnetic toner.
Figure 18:
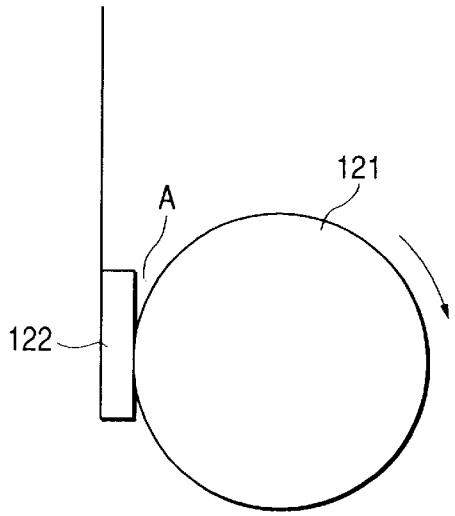
FIG. 18 is a view showing a wedge-shaped portion formed in an abutting nip portion of a developing sleeve and a developing blade in the developing apparatus of FIG. 17.

This developing apparatus 4 is arranged as developing apparatuses 104Y to 104K of an image forming apparatus as shown in FIG. 15 and is used to develop an electrostatic latent image on a photosensitive drum 110. In this embodiment, the developing apparatus 4 is constructed by a developing cartridge detachably attachable to a main body of the image forming apparatus, but can be also of a fixed arrangement type.

As shown in FIG. 1, the developing apparatus 4 has a developing sleeve 1, a developing blade 2, a toner supply collecting roller 3, an agitating blade 5, etc. in a developing container 6 storing nonmagnetic toner (one-component toner) T of a one-component developer.

The developing sleeve 1 is basically constructed by a cylindrical body formed by a metal such as aluminum, its alloy, and stainless. No metallic material is particularly limited if it is easy to cylindrically mold and process the metallic material. In this embodiment, the developing sleeve 1 is constructed by forming a film layer in which spherical particles are added to a binding resin binder on the surface of a cylindrical body having 20 mm in outside diameter and made of aluminum. A well-known material can be used in each of the binding resin binder and the spherical particles. Thus, a frictional charging property with respect to toner and the mechanical strength of a surface of the developing sleeve 1 are improved, but the present invention is not limited to the construction in which the film layer is formed. The developing sleeve 1 is rotated in an arrow direction in FIG. 1 at a predetermined circumferential speed.

The developing blade 2 as a toner regulating member is arranged above the developing sleeve 1 and is supported by a pressing metal plate 7 such that a portion of the developing blade 2 near its tip on a free end side abuts on an outer circumferential face of the developing sleeve 1 in a face contact state. An abutting direction of the developing blade 2 is a so-called counter direction in which a tip side of the developing blade 2 is located on an upstream side of the developing sleeve 1 in its rotating direction with respect to an abutting portion.

In this embodiment, the developing blade 2 is constructed by adhering or injection-molding a polyamide elastomer of 1 mm in thickness as an elastic member 2*b* to a phosphorus bronze plate having 0.1 mm in thickness and an elastic property as a metallic thin plate 2*a*. A side of the elastic member 2*b* abuts on the surface of the developing sleeve 1 at a predetermined line pressure. An abutting force of the developing blade 2 with respect to the developing sleeve 1 is maintained by the metallic thin plate 2*a*, and a charging property with respect to the toner of a negative charging property is provided by the polyamide elastomer. A metallic thin plate is not particularly limited if the metallic thin plate maintains the abutting force of the developing blade. Further, the elastic member can be selected in consideration of the charging property of the toner. The elastic member has a resistance value equal to or greater than a predetermined value by an applied voltage to prevent leakage between the developing sleeve 1 and the metallic thin plate of the developing blade 2.

In the present invention, the metallic thin plate of this developing blade 2 also functions as an electrode when a voltage (blade bias) is applied to the developing blade 2. A developing power source 8 is connected to the developing sleeve 1 and a blade power source 9 is connected to the metallic thin plate of the developing blade 2. A control operation is performed such that a predetermined electric potential difference is formed between the metallic thin plate and the developing sleeve 1. An application method of the bias voltage to the developing blade 2, etc. and its operating effects will be described later.

The toner supply roller 3 is preferably constructed by a sponge structure and a fur brush structure formed by implanting fibers of rayon, nylon, etc. on a core bar in view of the supply of toner to the developing sleeve and scrape of the toner left in the development. In this embodiment, an elastic roller of 20 mm in diameter having urethane foam on the core bar is used. The supply roller 3 constructed by this elastic roller abuts on the developing sleeve 1 and is used by rotating this supply roller 3 in the same direction as the developing sleeve 1 by an unillustrated driving means.

The toner T will be explained. In this embodiment, toner approximately formed in a spherical shape to greatly improve transfer efficiency is used as the nonmagnetic toner T. Concretely, a toner having a shape factor SF1 of 100 to 180 and a shape factor SF2 of 100 to 140 is used.

These shape factors SF1, SF2 are defined as values calculated by the following formulas in which FE-SEM (S-800) manufactured by Hitachi Ltd. is used and 100 toner images are sampled at random and information of their images is inputted to an image analyzer (Lusex3) manufactured by Nicolet Japan Corporation through an interface and an analyzing operation is performed.

$$SF1=\{(MXLNG)^2/AREA\}\times(\pi/4)\times100$$

$$SF2=\{(PERI)^2/AREA\}\times(1/4\pi)\times100$$

Here, MXLNG, AREA and PERI respectively designate an absolute maximum length, a toner projecting area, and circumference length.

The shape factor SF1 of this toner shows a spherical degree and the toner is gradually formed in an undefined shape from the spherical shape as this shape factor is increased from 100. The shape factor SF2 shows a degree of asperity (unevenness) and asperity of the toner surface become notable as this shape factor is increased from 100.

A manufacturing method of the toner is not particularly limited if the toner lies within the above ranges of the shape factors. For example, plastic spherical processing can be performed on the surface of the conventional grinding toner by thermal and mechanical stresses. Further, it is also possible to use a method for directly manufacturing toner by a suspension polymerization method, a dispersion polymerization method for directly producing toner by using an aqueous organic solvent in which a monomer is soluble and an obtained polymer is insoluble, an emulsification polymerization method typically represented by a soap free polymerization method in which toner is produced by directly performing polymerization under the existence of a water soluble polarity starting agent, etc.

In this embodiment, the shape factor SF1 can be relatively easily adjusted to a value from 100 to 180 and the shape factor SF2 can be relatively easily adjusted to a value from 100 to 140 as polymerization toner so that fine particle toner having a sharp particle size distribution and a particle diameter from 4 to 8 $\mu$m is obtained. The suspension polymerization method is used under a normal pressure or a pressurized pressure and styrene and n-butyl acrylate are used as the monomer. Further, a salicylate metallic compound is used as a charging control agent and saturated polyester is used as a polarity resin and a coloring agent is further added. Thus, coloring suspended particles of about 7 $\mu$m in weight average particle diameter are manufactured.

This toner is used by externally adding silicate fine powder as inorganic fine powder to this toner. The silicate fine powder is constructed by silica, etc. and organic processing such as coupling processing and oil processing can be performed on a surface of this silicate fine powder. Further, it is preferable that a BET ratio surface area using nitrogen adsorption ranges from 30 to 400 $m^2/g$. In this embodiment, 1.2 wt % of hydrophobic silica is externally added, but the present invention is not limited to this case.

Further, fine powder having a polarity reverse to that of the toner, i.e., fine powder showing a positive charging property and fine powder showing a weak charging property are externally added to the toner of a negative charging property to improve a developing property and a transfer property of the toner. Further, fine powder having effects as a polishing agent is externally added to the toner to prevent filming of the photosensitive drum.

There is a composite metallic oxide fine particle represented by $$M_xTi_yO_z \quad (1)$$

as fine powder having effects as a polishing agent. Here, M, Ti and O respectively designate a metallic element, a titanium element and an oxygen atom, and each of X, Y and Z is a nonzero positive number. For example, M is constructed by an element such as strontium, barium, magnesium, and calcium. When M is strontium among these elements, effects as the polishing agent are particularly high.

In this embodiment, 1.2 wt % of hydrophobic silica and 0.8 wt % of fine powder next shown are externally added to nonmagnetic toner of the negative charging property having a value of the shape factor SF1 from 100 to 180, a value of the shape factor SF2 from 100 to 140, and about 7 $\mu$m in weight average particle diameter. This toner is used in the developing apparatus 4 of the above construction in the developing operation and an image is formed. Then, an experiment is made as to whether the toner ununiformly stays in a longitudinal direction of the developing sleeve in the abutting nip portion of the developing blade 2 and the developing sleeve 1.

Concretely, nonmagnetic toners of three kinds different in accordance with the fine powder externally added are used. This fine powder is constructed by (a) a metallic oxide $SrTiO_3$ as inorganic fine powder having polishing agent effects, (b) a metallic oxide $SrSiO_3$ having no polishing agent effects, and (c) a separate metallic oxide $CaTiO_3$ having polishing effects.

In the experiment, an image forming apparatus similar to the conventional image forming apparatus is used and 500 images are formed. All abutting conditions of the developing blade 2 on the developing sleeve 1 are set to the same and a line pressure per 1 cm in the longitudinal direction of the developing sleeve is set to 25 g/cm and a distance from an abutting uppermost stream position (an upper stream in a sleeve rotating direction) to a blade free end is set to 1 mm. In this case, the metallic thin plate of the developing blade and the developing sleeve are set to an equal electric potential. The results are shown in Table 1.

TABLE 1

| | Fine powder | Presence/Absence of staying |
|---|---|---|
| (a) | $SrTiO_3$ | Generated |
| (b) | $SrSiO_3$ | Generated |
| (c) | $CaTiO_3$ | Generated |

As shown in Table 1, the toner ununiformly stays in the longitudinal direction in all the experiments using fine powders (a) to (c).

Figure 14:
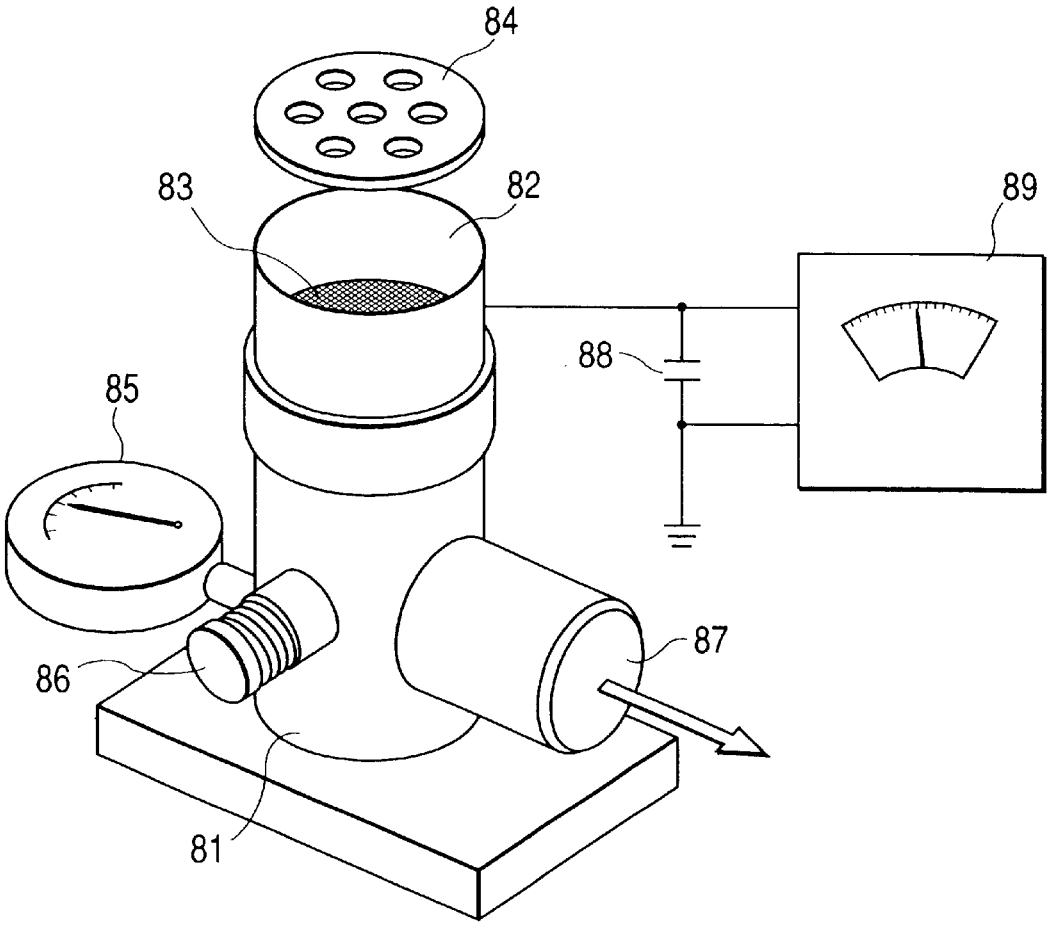
FIG. 14 is a perspective view showing a measuring device used to measure a charging amount of fine powder added to toner in the present invention.

A frictional charging amount of the fine powder is measured under a circumference of 23° C. in temperature and 60% in humidity by using EFV 200/300 (manufactured by Powder-Tech Co., Ltd.) as a carrier. 10.0 g of this carrier and 0.2 g of fine powder are stored to a container of 50 ml in capacity made of polyethylene and are manually shaken 90 times. Next, as shown in FIG. 14, the carrier and the fine powder are stored to a metallic container 82 for measurement in which the bottom of a measuring device is constructed by a conductive screen 83 of 500 meshes. The container 82 is covered with a metallic cover 84. An entire weight of the container 82 for measurement in this state is measured and is set to W1 (g).

Next, the container 82 for measurement is arranged in an aspirator 81 (a portion of the aspirator 81 coming in contact with at least the container 82 for measurement is constructed by an insulator), and a sucking operation is performed from a sucking port 87. The pressure of a vacuum gauge 85 is set to 2450 Pa by adjusting an air quantity control valve 86 and the sucking operation is performed for two minutes in this state so that the fine powder is sucked and removed. At this time, an electric potential indicated by an electrometer 89 connected to the container 82 for measurement is read and is set to V1 (V). The entire weight of the container 82 for measurement after the suction is measured and is set to W2 (g). When the capacity of a capacitor 88 connected to the container 82 for measurement in parallel with the electrometer 89 is set to C1 (mF), the frictional charging amount of the fine powder is calculated by the following formula. Frictional charging amount (mC/kg)=C1×V1/(W1−W2)

It has been found from these results that the staying phenomenon of the toner is caused irrespective of the existence of effects as a polishing agent and kinds of the metallic oxide near the abutting nip portion of the developing blade 1 and the developing sleeve 2.

Namely, these fine powders have the positive charging property with respect to the carrier (iron powder), or has the weak charging property equal to or smaller than 10 $\mu$C/g in absolute value. A charging amount with respect to the iron powder carrier of one-component toner and a charging amount with respect to the iron powder carrier of one-component toner externally adding hydrophobic silica used in this embodiment range from −30 to −80 $\mu$C/g. Accordingly, in the developing apparatus of the present invention, it has been found that the fine powder is charged in a polarity reverse to that of the toner from a charging series when the fine powder is frictionally charged by the toner. In view of the above description, the ununiform staying phenomenon of the toner in the longitudinal direction of the developing sleeve 1 is caused since the toner and the fine powder charged in a polarity reverse to that of the toner are electrostatically cohered.

As described in the conventional example, when this electrostatic coherence is particularly caused in the wedge-shaped portion on a downstream side in the rotating direction of the developing sleeve in the abutting nip portion of the developing blade 2 and the developing sleeve 1, the toner accumulating is gradually grown in the wedge-shaped portion by rotating the developing sleeve at a time of the developing operation and finally becomes a cohering lump. As the developing sleeve is rotated, the toner cohering lump drops from the wedge-shaped portion and causes a poor image.

The inventors of this application noticed the electric potential difference between the developing sleeve and the developing blade and made an experiment to solve this problem. In this experiment, three kinds of toners constructed by fine powders (a) to (c) used in the experiment of Table 1 are used and idle rotation of the developing sleeve 1 is performed to further clarify the nonuniform staying phenomenon of the toner in the longitudinal direction. Thus, existence of the toner accumulating is confirmed by changing the electric potential difference between the developing blade 2 and the developing sleeve 1.

An abutting condition of the developing blade on the developing sleeve is the same as the above case. Namely, a line pressure per 1 cm in the longitudinal direction of the developing sleeve is set to 25 g/cm and a distance from an abutting uppermost stream position (an upper stream in the sleeve rotating direction) to a blade free end is set to 1 mm. As mentioned above, The power sources 8 and 9 are respectively connected to the developing sleeve 1 and the developing blade 2. A direct current voltage −350 V as a developing bias voltage is applied to the developing sleeve 1 in consideration of a developing time. The direct current voltage is applied to the metallic thin plate of the developing blade 2 by changing this direct current voltage from 0 to −500 V. When the direct current voltage is 0 V, the developing blade is connected to the ground. The results are shown in Table 2.

TABLE 2

| Blade application voltage | Presence/Absence of generation of staying of toner | | |
|---|---|---|---|
| (V) | (a) | (b) | (c) |
| 0 | not generated | not generated | not generated |
| −100 | not generated | not generated | not generated |
| −200 | not generated | not generated | not generated |
| −300 | not generated | not generated | not generated |
| −350 | generated | generated | generated |
| −400 | generated | generated | generated |
| −500 | generated | generated | generated |

It has been found from the Table 2 that the ununiform accumulation of the toner in the longitudinal direction of the developing sleeve can be prevented in one-component toner of the negative charging property when the direct current voltage (set to DC2) applied to the developing blade satisfies $$DC1 < DC2 \leqq 0$$

with respect to the direct current voltage (set to DC1) applied to the developing sleeve.

As a result of a further consideration, it is restrained by setting the electric potential of the developing blade width respect to the developing sleeve on a plus side that the fine powder charged in a polarity reverse to that of one-component toner of the negative charging property is electrostatically cohered particularly in the abutting portion of the developing sleeve and the developing blade and a portion near this abutting portion. Thus, it has been found that the generation of the nonuniform accumulation of the toner caused in the longitudinal direction is prevented by this restraint.

In the case of one-component toner of the positive charging property, it is sufficient to set the electric potential of the developing blade with respect to the developing sleeve on a minus side if the fine powder charged in a polarity reverse to that of this toner is externally added.

However, in the developing apparatus repeating the developing operation many times, no ununiform staying of the toner in the longitudinal direction can be dissolved even when the direct current voltage is applied to the developing sleeve and the developing blade. Further, a cohering degree of the toner is extremely increased in the developing apparatus repeating the developing operation many times.

When the developing operation is repeated many times, the cohering degree of the toner is increased and the toner nonuniformly accumulates. To consider this cause, the following matters have been found as a result of an observation of the toner after an endurance test.

(1) Silicate fine powder is buried onto the toner surface after the toner is used in the endurance test. (2) In addition to this, a relative weight ratio of each of the positive charging property fine powder and the weak charging property fine powder externally added to the negative charging property toner and having the reverse polarity with respect to the toner is increased after the endurance test in comparison with an initial stage.

It has been found from these results that when the developing operation is repeated many times, the toner is frictionally deteriorated by sliding friction due to another toner, the developing blade and the developing sleeve, and is more likely to be deteriorated particularly by shearing force caused by sliding friction of the developing sleeve 1 and the supply roller 3 in nonmagnetic toner. Therefore, it has been found that the silicate fine powder is buried on the toner surface and giving effects of fluidity operated by the existence of the fine powder between the toners are lost so that the cohering degree is increased.

Further, it has been found that the electrostatic coherence of the toner and the fine powder is more easily caused since the relative weight ratio of each of the positive charging property fine powder and the weak charging property fine powder in the reverse polarity with respect to the toner is increased after the endurance test in comparison with the initial stage of the toner.

To solve this problem, an experiment is made by noticing a voltage applied to the developing sleeve 1 and the developing blade 2. In this experiment, idle rotation of the developing sleeve is performed and the electric potential difference between the developing blade and the developing sleeve is changed to further clarify the nonuniform accumulating phenomenon of the toner in the longitudinal direction, and the existence of the toner staying is confirmed. The idle rotation is performed for ten hours corresponding to an endurance life of the developing apparatus.

Similar to the above case, in an abutting condition of the developing blade on the developing sleeve, a line pressure per 1 cm in the longitudinal direction of the developing sleeve is set to 25 g/cm, and a distance from an abutting uppermost stream position (an upper stream in the sleeve rotating direction) to a blade free end is set to 1 mm.

First, an alternating current voltage is applied to the developing sleeve 1 as a developing bias in consideration of the developing operation. At this time, Vpp of the alternating current voltage is changed, but its effective value is set to −350 V at any time. In contrast to this, −200 V is applied to the metallic thin plate of the developing blade. The results are in Table 3.

TABLE 3

| Alternating current voltage (Vpp) | Presence/Absence of toner staying |
|---|---|
| 0 | generated |
| 400 | not generated |
| 800 | not generated |
| 1200 | not generated |
| 1600 | not generated |
| 2000 | not generated |

Next, a direct current voltage −350 V is applied to the developing sleeve, and the alternating current voltage is applied to the metallic thin plate of the developing blade. At this time, Vpp of the alternating current voltage is changed, but its effective value is set to −200 V at any time. The results are shown in Table 4.

TABLE 4

| Alternating current voltage (Vpp) | Presence/Absence of toner staying |
|---|---|
| 0 | generated |
| 400 | not generated |
| 800 | not generated |

TABLE 4-continued

| Alternating current voltage (Vpp) | Presence/Absence of toner staying |
|---|---|
| 1200 | not generated |
| 1600 | not generated |
| 2000 | not generated |

It has been found from the above results that the nonuniform accumulation of the toner in the longitudinal direction can be also dissolved in the vicinity of the abutting nip portion of the developing sleeve 1 and the developing blade 2 in the developing apparatus repeating the developing operation many times if at least one of the developing bias applied to the developing sleeve I and the blade bias applied to the developing blade 2 is set to the alternating current voltage.

It is considered that this is because the developing blade is vibrated by an alternating electric field formed in the abutting portion of the developing sleeve and the developing blade by applying the alternating current voltage to at least one of the developing sleeve 1 and the developing blade 2, and the toner increased in coherence degree by repeating the developing operation is unbound (crumbed) and does not stay.

In consideration of the above experimental results, at least one of the developing bias applied to the developing sleeve 1 and the blade bias applied to the developing blade 2 is set to the alternating current voltage in the present invention. Further, The above DC1 and DC2 are reused and a direct current voltage value or an alternating current voltage effective value of the developing bias is set to the voltage value DC1, and a direct current voltage value or an alternating current voltage effective value of the blade bias is set to the voltage value DC2. At this time, the voltage value DC1 of the developing bias and the voltage value DC2 of the blade bias are set on the same polarity side as the charging polarity of the toner such that the voltage value DC2 of the blade bias is set on a reverse polarity side to the charging polarity of the toner with respect to the voltage value DC1 of the developing bias.

Namely, in this embodiment, $$DC1 < DC2 \leqq 0 \quad (2)$$

is set since the toner of the negative charging property is used.

Figure 2:
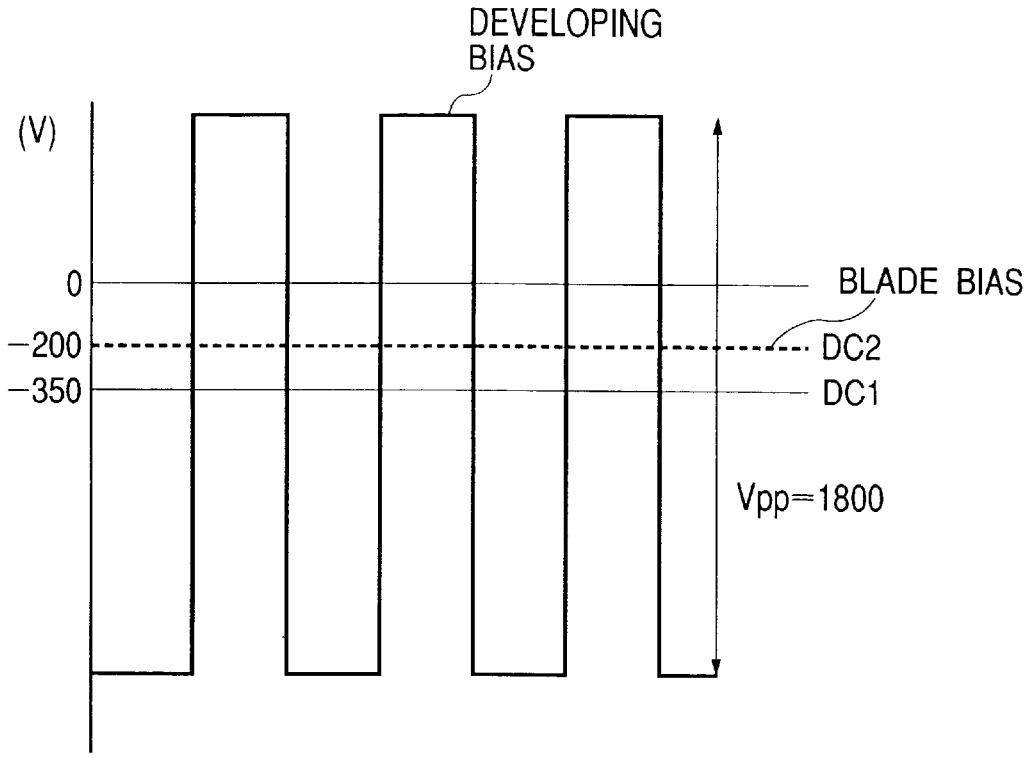
FIG. 2 is a view showing the waveform of a bias voltage applied to a developing sleeve and a developing blade of the developing apparatus of FIG. 1.

Concretely, as shown in FIG. 2, the alternating current voltage having 1800 V in Vpp and −350 V in the effective value DC1 is applied to the developing sleeve as the developing bias. The direct current voltage having −200 V in the direct current voltage value DC2 is applied to the developing blade as the blade bias.

The present invention is not limited to this case, but the voltage value DC1 of the developing bias applied to the developing blade, i.e., the direct current voltage value or the effective value of the alternating current voltage may be set on a polarity side reverse to the charging polarity of the toner from the voltage value DC2 of the blade bias applied to the developing sleeve, i.e., the direct current voltage value or the effective value of the alternating current voltage.

When the developing operation is performed for a long period in this condition until an endurance life of the developing apparatus, there is no phenomenon in which the toner excessively accumulates so that a toner cohering lump drops and a poor image is caused.

Since this embodiment has the above construction, it is possible to prevent one-component toner from nonuniformly accumulating in the longitudinal direction in the abutting nip portion of the developing blade and the developing sleeve in the conventional problem. Accordingly, the toner thin layer of a uniform thickness can be stably formed on the developing sleeve so that a latent image on the photosensitive drum can be preferably developed.

Further, it is possible to prevent the toner from being cohered in the abutting nip portion of the developing blade and the developing sleeve even when fine powder showing a polarity reverse to that of the toner is externally added to the toner. Accordingly, the toner thin layer of a uniform thickness can be stably formed on the developing sleeve so that the latent image on the photosensitive drum can be preferably developed.

Further, the staying phenomenon of toner having a high cohering degree is prevented in the abutting nip portion of the developing blade and the developing sleeve. Accordingly, the toner thin layer of a uniform thickness can be stably formed on the developing sleeve until the endurance life so that the latent image on the photosensitive drum can be preferably developed.

Embodiment 2

In this embodiment, the constructions of the developing sleeve 1 and the developing blade 2 are changed in the developing apparatus of the embodiment 1 shown in FIG. 1. The other constructions in this embodiment are similar to those in the embodiment 1. This embodiment will next be explained with reference to FIG. 1.

In this embodiment, the developing sleeve 1 is constructed such that an elastic layer formed by a basic layer and a surface layer on this basic layer is arranged around a metallic cylindrical body of aluminum, its alloy, stainless, etc. The developing sleeve 1 has 20 mm in outside diameter. The basic layer of the elastic layer is constructed by rubber such as NBR, and the surface layer is constructed by ether urethane, nylon, etc. However, materials of the basic layer and the surface layer are not limited to these materials. The basic layer can be also constructed by using a foam body of sponge, etc., and the surface layer can be also constructed by forming a rubber elastic layer, etc. A suitable value can be selected as resistance of the developing sleeve 1 to prevent leakage between the developing sleeve 1 and the developing blade 2 and obtain preferable image quality.

In this embodiment, the developing blade 2 is constructed by only a thin plate made of a SUS metal and having spring elasticity and 0.1 mm in thickness. The developing blade 2 abuts on a surface of the developing sleeve 1 at a predetermined line pressure.

Similarly to the embodiment 1, the developing blade 2 may be constructed such that an elastic member 2*b* of silicon, urethane, etc. is arranged on an abutting portion side of the metallic thin plate 2*a* on the developing sleeve 1 to maintain press contact force of the developing blade 2 with respect to the developing sleeve 1 and provide a preferable charging property for the toner of the negative charging property.

Similarly to the embodiment 1, the toner nonuniformly accumulates in a longitudinal direction in an abutting nip portion of the developing blade 2 and the developing sleeve 1 in the developing apparatus 4 in this embodiment. When a developing operation is repeated many times, an accumulating toner amount becomes excessive and the toner drops from the developing sleeve surface to the exterior so that a poor image is caused and no developing apparatus can be used.

In contrast to this, when an electric potential of the developing blade 2 is set to a plus side with respect to the developing sleeve 1, fine powder charged in a polarity reverse to that of the toner of the negative charging property is not attached to the developing blade 2, but is positively supplied to a side of the developing sleeve 1. Thus, it has been found that electrostatic coherence of the fine powder is restrained particularly in the abutting portion of the developing sleeve and the developing blade and a portion near this abutting portion so that the nonuniform accumulation of the toner in the longitudinal direction caused by the coherence of the fine powder can be prevented.

If fine powder charged in a polarity reverse to that of the toner of a positive charging property is externally added to this toner, the electric potential of the developing blade 2 with respect to the developing sleeve 1 is set to a minus side. Further, the nonuniform accumulating phenomenon of the toner in the longitudinal direction can be dissolved by applying an alternating current voltage to the developing blade 2 when the developing operation is repeated approximately until an endurance life.

In consideration of the above experimental results, in this embodiment, a direct current voltage is applied to the developing sleeve 1 of the developing apparatus as a developing bias, and an alternating current voltage is applied to the developing blade 2 as a developing bias. An effective value DC2 of the alternating current voltage of the blade bias with respect to the direct current voltage DC1 of the developing bias is set to satisfy the following relation.

$$DC1 < DC2 \leqq 0$$

Figure 3:
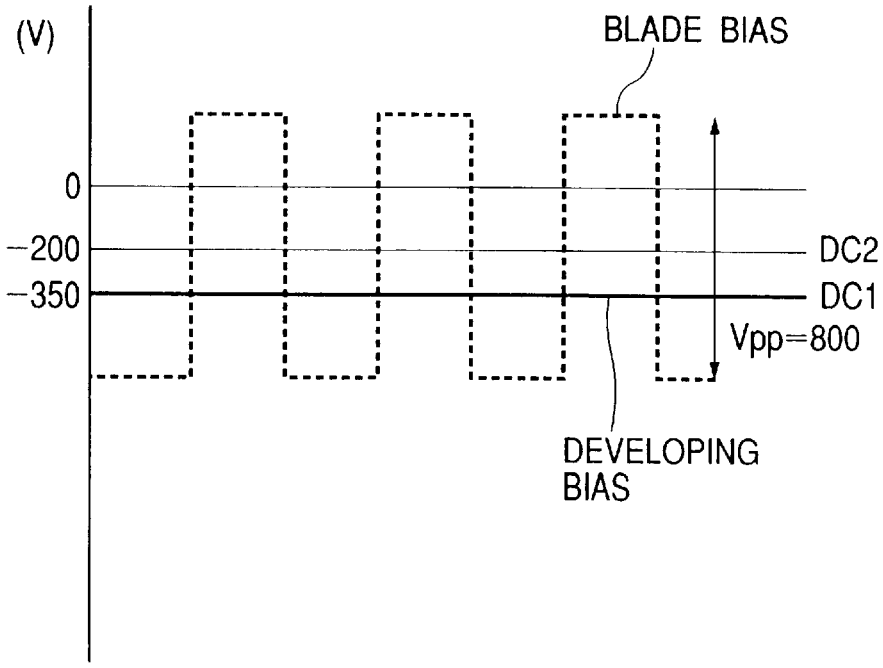
FIG. 3 is a view showing a waveform of the bias voltage applied to the developing sleeve and the developing blade in another embodiment of the present invention.

Concretely, as shown in FIG. 3, the direct current voltage DC1 of the developing bias applied to the developing sleeve is set to −350 V, and the alternating current voltage of the blade bias applied to the developing blade is set to 800 V in Vpp and −200 V in the effective value DC2. However, these voltages are not limited to these values.

When the developing operation is performed in this condition for a long period, there is no phenomenon in which the toner excessively accumulates so that a toner cohering lump drops and a poor image is caused.

Since this embodiment is constructed as mentioned above, effects similar to those in the embodiment 1 are obtained. Namely, the nonuniform accumulation of one-component toner in the longitudinal direction in the conventional problem is prevented in the abutting nip portion of the developing blade and the developing sleeve. Further, when fine powder showing a polarity reverse to that of the toner is externally added to this toner, coherence of the toner is prevented and accumulation of the toner of a high cohering degree is prevented. Accordingly, in each case, the toner thin layer of a uniform thickness can be stably formed on the developing sleeve and a latent image on the photosensitive drum can be preferably developed. externally added to this toner, coherence of the toner is prevented and accumulation of the toner of a high cohering degree is prevented. Accordingly, in each case, the toner thin layer of a uniform thickness can be stably formed on the developing sleeve and a latent image on the photosensitive drum can be preferably developed.

In the above embodiments 1 and 2, the developing apparatus 4 is used as a developing cartridge detachably attachable to a main body of the image forming apparatus as shown in FIG. 15. However, the developing apparatus may be of a type in which the toner is replenished by fixedly arranging the developing cartridge in the main body of the image forming apparatus. Further, at least the developing apparatus 4 and the photosensitive drum 110 may be integrally assembled and may be also constructed as a process cartridge detachably attachable to the main body of the image forming apparatus. A cleaner 106, a charger 102, etc. shown in FIG. 15 can be also assembled into this process cartridge.

Embodiment 3

Figure 4:
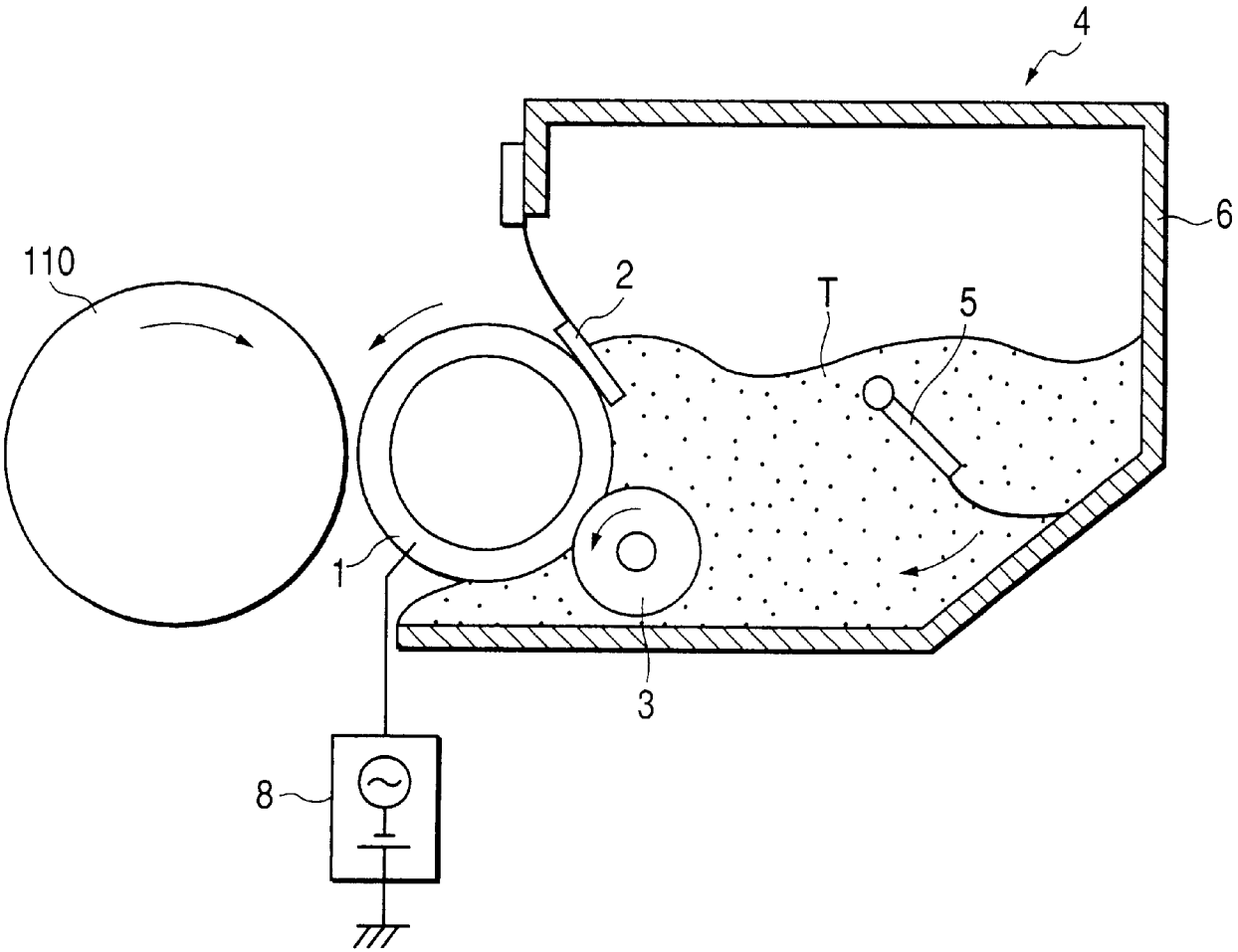
FIG. 4 is a schematic view showing a still another embodiment of the developing apparatus of the present invention.

FIG. 4 is a schematic structual view showing a still another embodiment of the developing apparatus of the present invention.

In this embodiment, a developing power source 8 for applying a developing bias to the developing sleeve 1 is arranged. However, this embodiment differs from the embodiments 1 and 2 in that no blade power source for applying a blade bias to the developing blade 2 is arranged. Instead of this, this embodiment is characterized in that a voltage is divided by an RC equivalent circuit as shown in FIG. 5 from the developing bias applied to the developing sleeve 1 and the blade bias is applied to the developing blade 2.

The developing apparatus 4 may be of a type of an arrangement fixed to the main body of the image forming apparatus, and may be also of a type of a developing cartridge detachably attachable to this main body.

Figure 6:
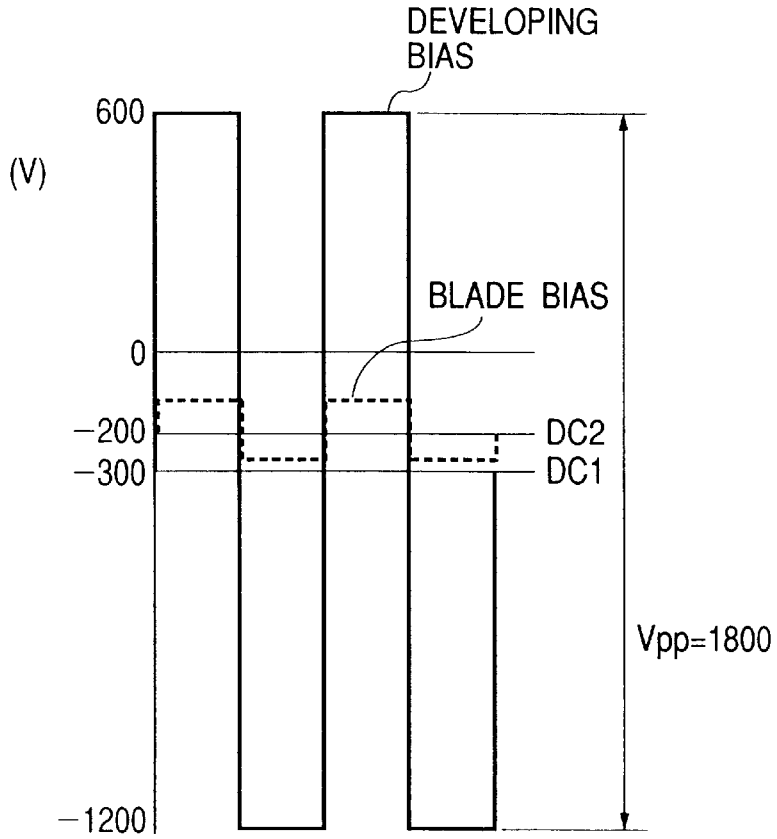
FIG. 6 is a view showing the waveform of a bias voltage applied to a developing sleeve and a developing blade of the developing apparatus of FIG. 4.

As shown in FIG. 6, the developing bias is set to a voltage in which Vdc=−300 V is superposed on an AC voltage of Vpp=1800 V and frequency f=2000 Hz. The AC voltage of an effective value −300 V is applied to the developing sleeve 1 at the time of a developing operation. Thus, the AC voltage of an effective value −200 V is applied to the developing blade 2 as a blade bias.

Figure 5:
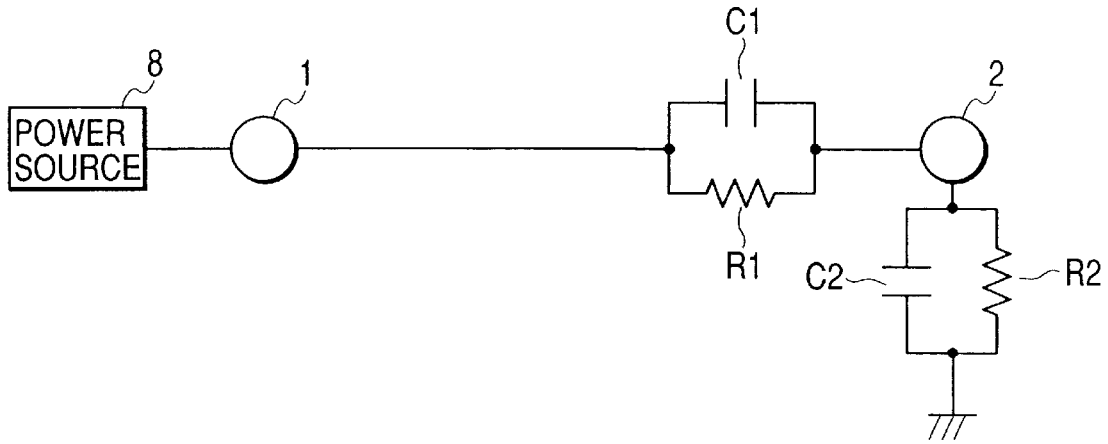
FIG. 5 is a view showing an equivalent circuit of a voltage dividing portion in the developing apparatus of FIG. 4.

The blade bias mainly divides the Vpp of the AC component of the developing bias in capacitors C1, C2 of FIG. 5, and the effective value or a direct current voltage is adjusted by resistances (resistors) R1, R2. The present invention is not limited to the circuit shown in FIG. 5 if it is an equivalent circuit for obtaining a similar bias.

This embodiment is constructed as mentioned above. Accordingly, similarly to the embodiment 1, the ununiform staying of one-component toner in the longitudinal direction is prevented in the abutting nip portion of the developing blade and the developing sleeve. Further, when fine powder showing a polarity reverse to that of the toner is prevented and accumulation of the toner of a high cohering degree is prevented. In each case, the toner thin layer of a uniform thickness can be stably formed on the developing sleeve and a latent image on the photosensitive drum can be preferably developed. Further, in this embodiment, it is not necessary to arrange a power source of the developing blade in addition to a power source of the developing sleeve. Accordingly, the developing apparatus and the image forming apparatus can be inexpensively manufactured and made compact.

Embodiment 4

Figure 7:
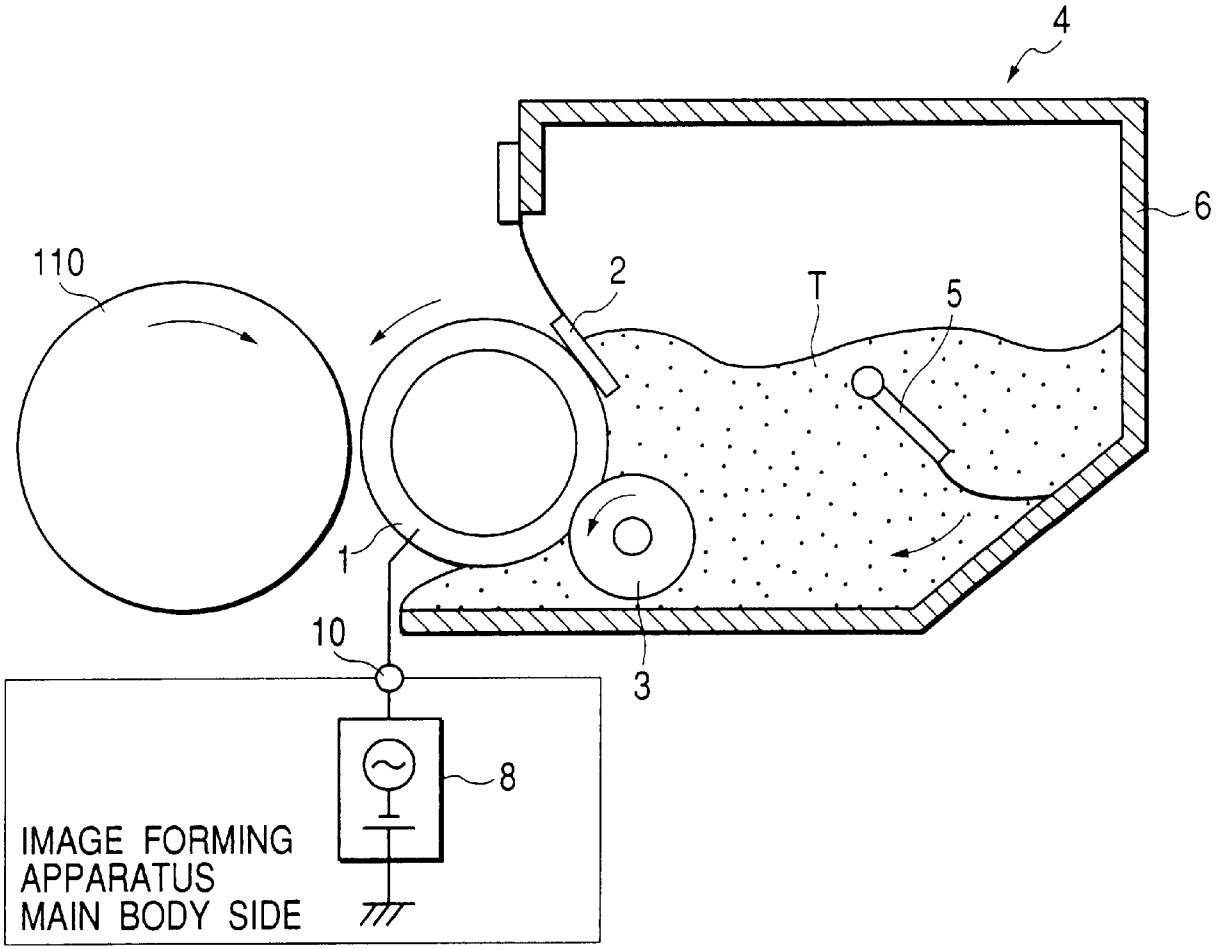
FIG. 7 is a schematic view showing a still another embodiment of the developing apparatus of the present invention.

In this embodiment, the developing apparatus 4 is constructed by a developing cartridge detachably attachable to a main body of the image forming apparatus. As shown in FIG. 7, the developing apparatus 4 has a power supply portion 10 connected to the developing sleeve 1. A developing power source 8 is arranged on a main body side of the image forming apparatus. When the developing apparatus 4 of this cartridge type is mounted to the main body of the image forming apparatus, the power supply portion 10 is connected to the developing power source 8.

In this embodiment, a developing bias applied from the power source 8 to the developing sleeve 1 is divided by an RC equivalent circuit of FIG. 5, i.e., a voltage dividing portion and a blade bias is applied to the developing blade 2. Thus, it is possible to preferably hold the electric potential difference between the developing sleeve 1 and the developing blade 2 even when the voltage of the power source 8 is dispersed.

In this embodiment, in the developing bias, Vdc=−300 V is superposed on an AC voltage of Vpp=1800 V and frequency f=2000 Hz. The AC voltage of an effective value −300 V is applied to the developing sleeve 1 as the developing bias at the time of a developing operation. The AC voltage of an effective value −200 V is applied to the developing blade 2 as a blade bias.

In this embodiment, similarly to the embodiment 3, the nonuniform accumulation of one-component toner in the longitudinal direction, etc. are prevented in the abutting nip portion of the developing blade and the developing sleeve. The toner thin layer of a uniform thickness can be stably formed on the developing sleeve and a latent image on the photosensitive drum can be preferably developed. Further, the developing apparatus and the image forming apparatus can be cheaply manufactured and made compact.

Embodiment 5

Figure 8:
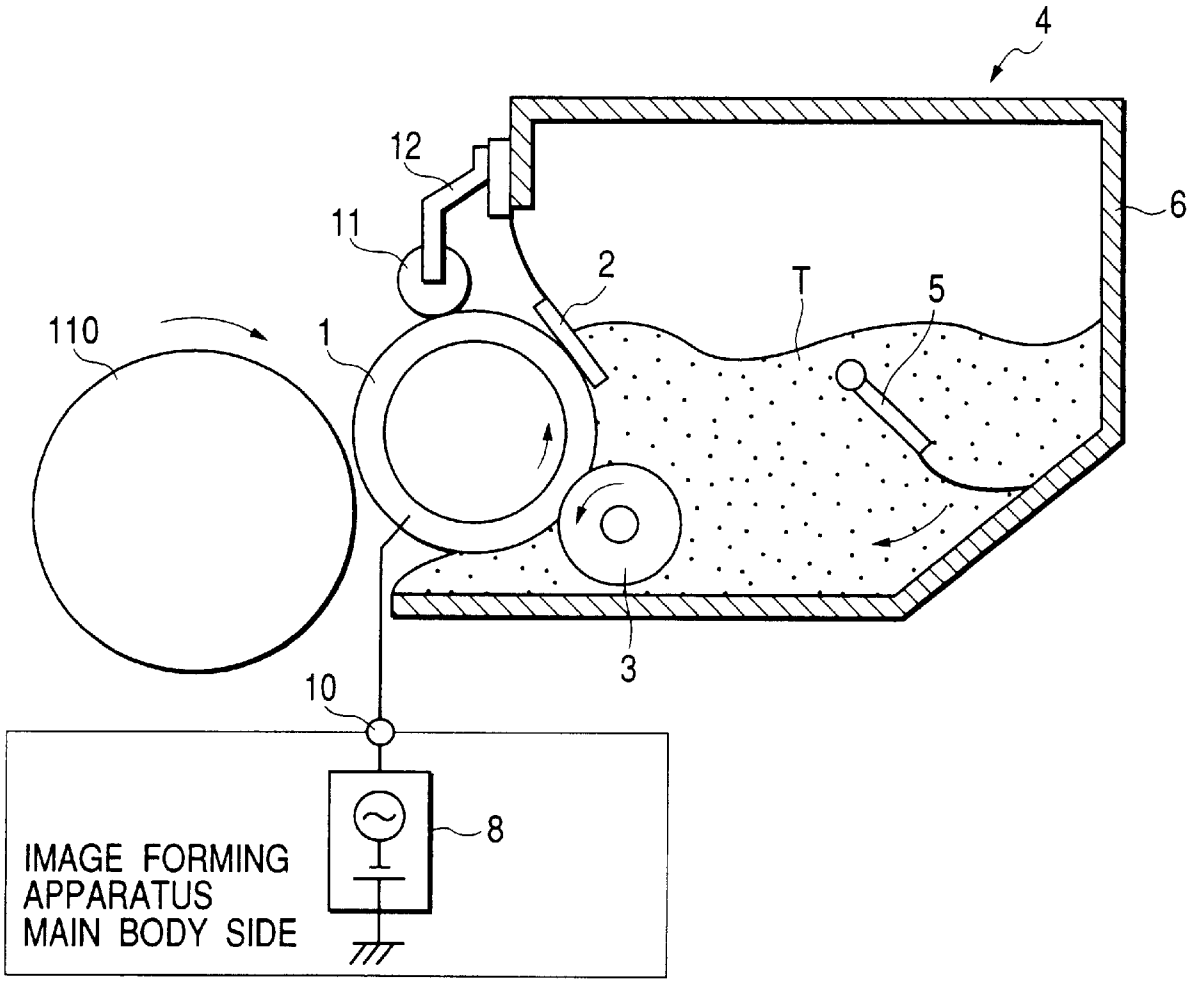
FIG. 8 is a schematic view showing a still another embodiment of the developing apparatus of the present invention.

In this embodiment, as shown in FIG. 8, a toner charging roller 11 is arranged with respect to the developing sleeve 1 of the developing apparatus 4. Similarly to the embodiment 4, the developing apparatus 4 is constructed by a developing cartridge detachably attachable to a main body of the image forming apparatus and has a power supply portion 10 connected to the developing sleeve 1.

The above toner charging roller 11 is constructed by a rubber roller made of NBR and is attached to a developing container 6 by a pressing member 12 and comes in press contact with a surface of the developing sleeve 1. The charging roller 11 is rotated at the same speed as the developing sleeve 1. The charging roller 11 may be rotated by the rotation of the developing sleeve 1 and may be also rotated independently of the rotation of the developing sleeve 1. When a toner layer on the developing sleeve 1 becomes nonuniform and a charging amount of the toner becomes insufficient, this toner charging roller 11 is used such that the toner insufficient in charging on the developing sleeve 1 is charged by applying a charging bias to the toner charging roller 11 and performing a discharging operation.

In this embodiment, when the developing apparatus 4 of a cartridge type is mounted to the main body of the image forming apparatus, the power supply portion 10 is also connected to a developing power source 8 arranged on a main body side of the image forming apparatus.

Figure 10:
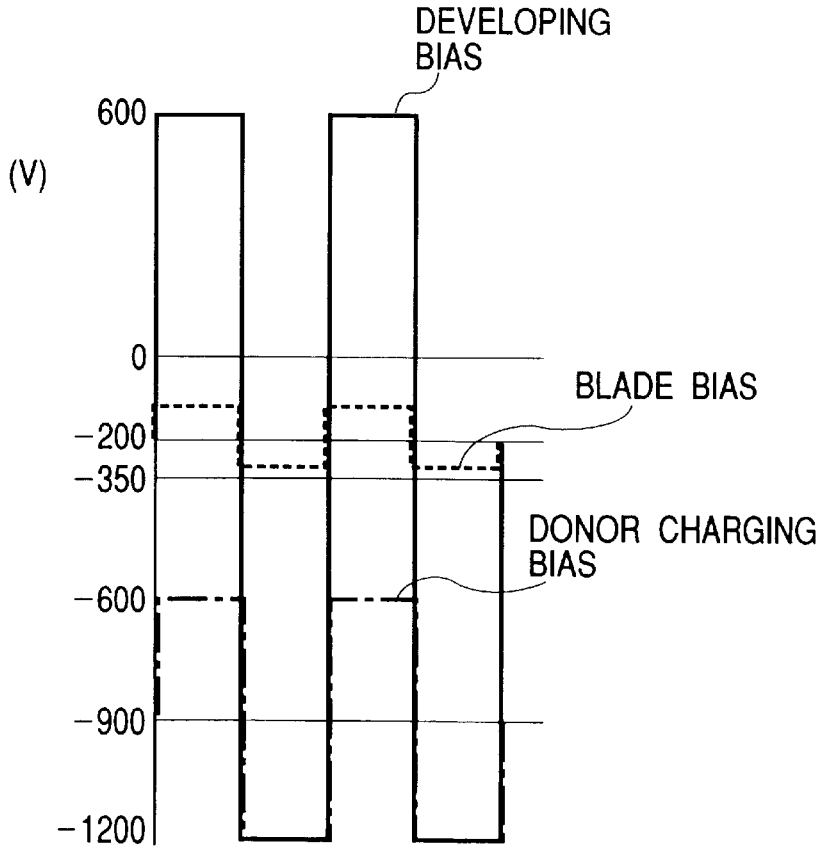
FIG. 10 is a view showing the waveform of a bias voltage applied to a developing sleeve, a toner charging roller and a developing blade of the developing apparatus of FIG. 8.

Similarly to the embodiment 1, in the developing bias, Vdc=−300 V is superposed on an AC voltage of Vpp=1800 V and frequency f=2000 Hz as shown in FIG. 10. The AC voltage of an effective value −300 V is applied to the developing sleeve 1 as the developing bias at the time of a developing operation.

Figure 9:
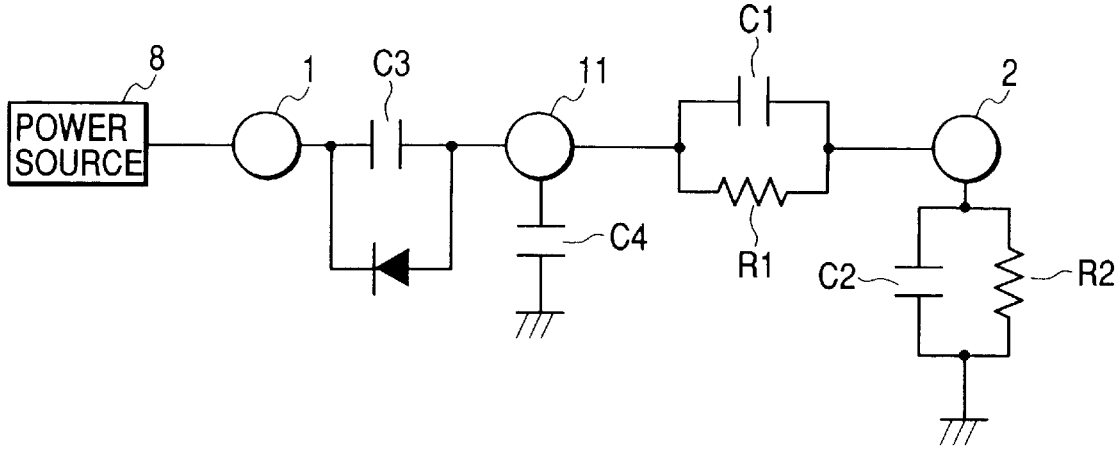
FIG. 9 is a view showing an equivalent circuit of a voltage dividing portion in the developing apparatus of FIG. 8.

In this embodiment, the charging bias is branched from the developing bias applied from the power source 8 to the developing sleeve 1, and is divided by an equivalent circuit (a voltage dividing portion) as shown in FIG. 9 and is applied to the toner charging roller 11.

As shown in FIG. 10, in the charging bias, Vdc=−950 V is superposed on the AC voltage of Vpp=600 V and frequency f=2000 Hz. The AC voltage of an effective value −950 V is applied at a time of the developing operation. This toner charging bias is adjusted by capacitors C3, C4 of the equivalent circuit of FIG. 9. The present invention is not limited to the equivalent circuit shown in FIG. 9 if it is an equivalent circuit for obtaining a similar bias.

A blade bias is branched from the toner charging bias applied to the toner charging roller 11 and is divided by an equivalent circuit (a voltage dividing portion) as shown in FIG. 9 and is applied to the developing blade 2.

The blade bias as shown in FIG. 10 is applied at the time of the developing operation. The Vpp of an AC component of the developing bias is mainly divided in capacitors C1, C2 of FIG. 10 and an effective value or a direct current voltage is adjusted by resistors R1, R2. The present invention is not limited to the circuit shown in FIG. 10 if it is an equivalent circuit for obtaining a similar bias.

In this embodiment, similarly to the embodiment 4, the ununiform accumulation of one-component toner in the longitudinal direction, etc. are prevented in the abutting nip portion of the developing blade and the developing sleeve. The toner thin layer of a uniform thickness can be stably formed on the developing sleeve and a latent image on the photosensitive drum can be preferably developed. Further, the developing apparatus and the image forming apparatus can be cheaply manufactured and made compact.

Embodiment 6

The mounting of a voltage supply system to the developing sleeve, etc. in the developing apparatus will be explained in this embodiment.

Figure 11:
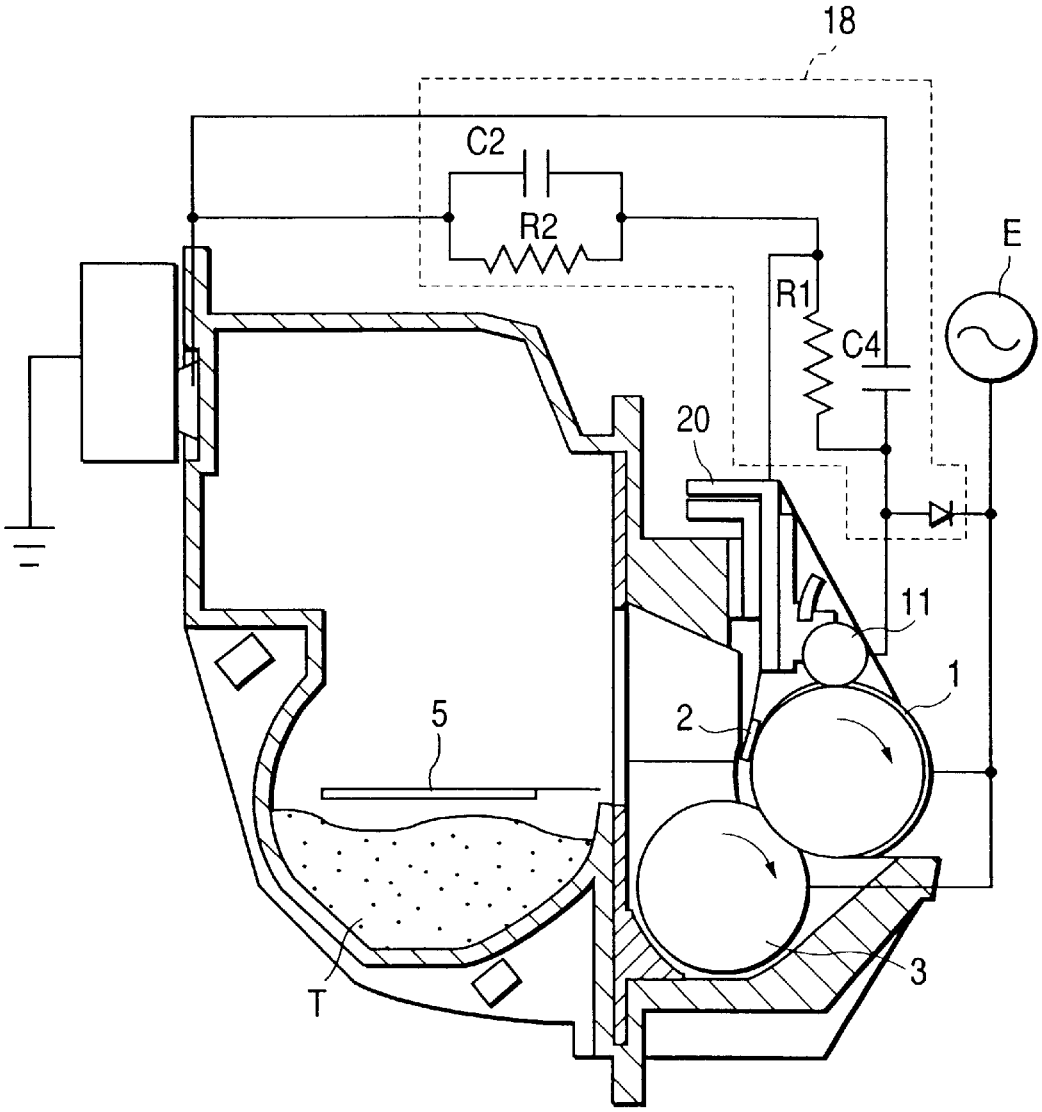
FIG. 11 is a cross-sectional view showing a developing cartridge in a still another embodiment of the present invention.
Figure 12:
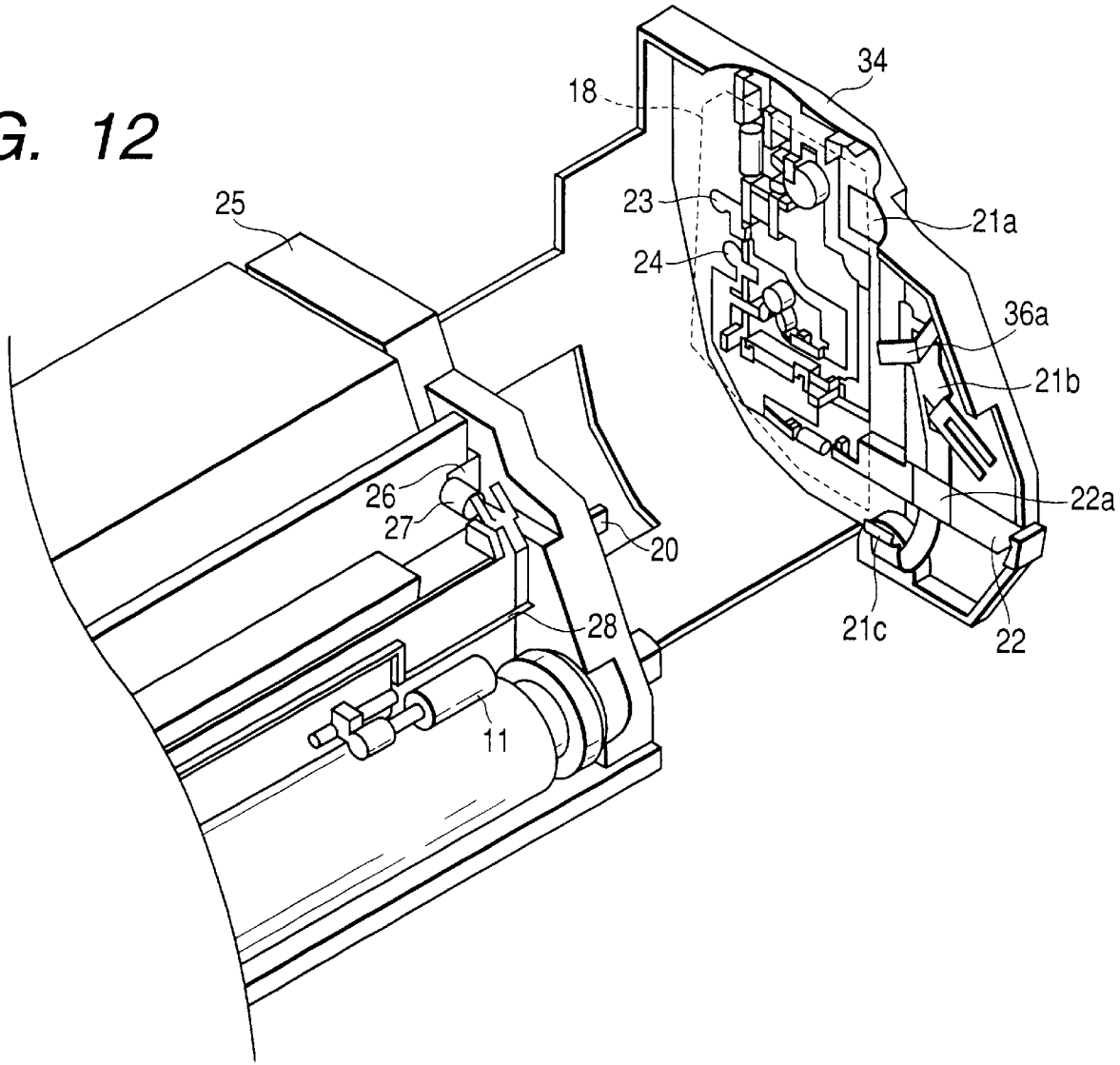
FIG. 12 is a perspective view showing the structure of connecting portions of the toner charging roller, etc. and a voltage generating circuit within a cover member of the developing cartridge of FIG. 11.
Figure 13:
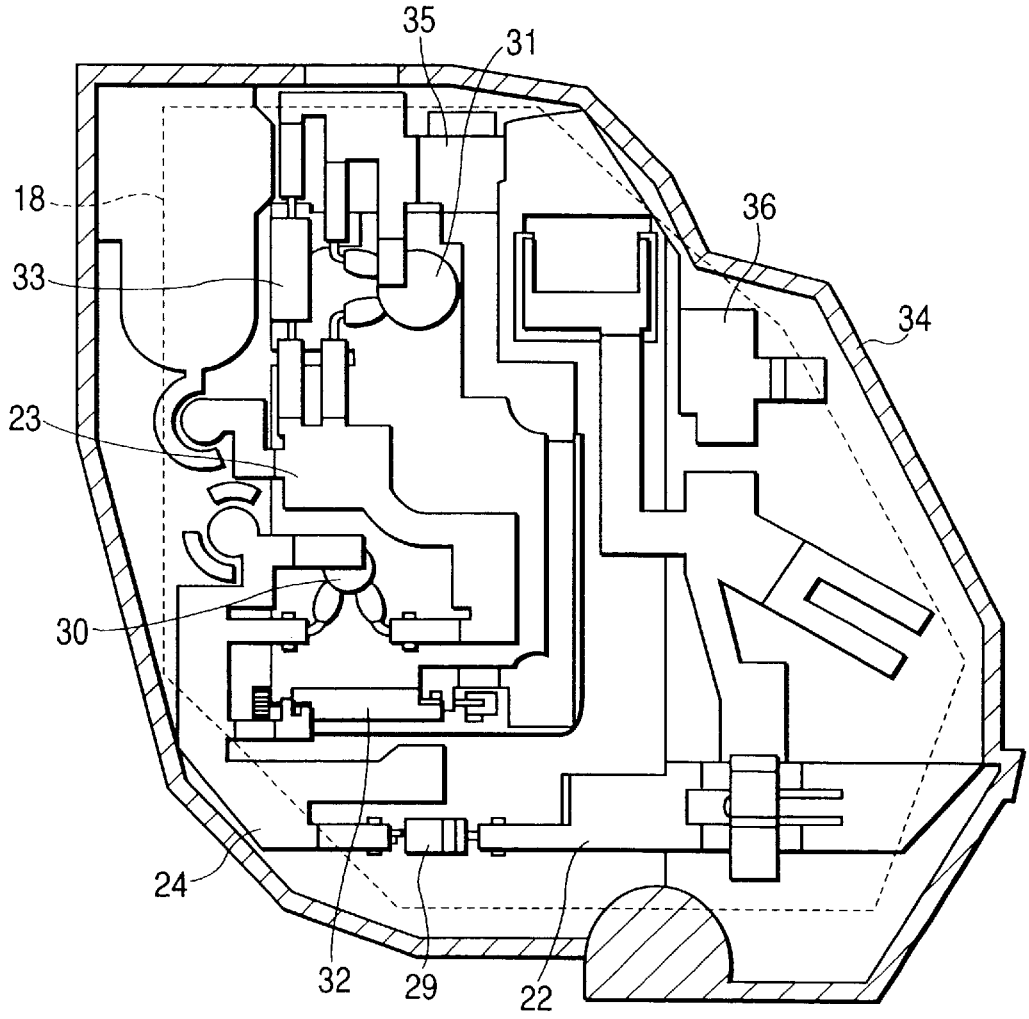
FIG. 13 is a cross-sectional view showing the cover member of the developing cartridge of FIG. 11 and the voltage generating circuit.

FIG. 11 is a cross-sectional view showing a developing cartridge in one embodiment of the present invention. FIG. 12 is a perspective view showing the structure of connecting portions of the toner charging roller, etc. and a voltage generating circuit within a cover member of the developing cartridge of FIG. 11. FIG. 13 is a cross-sectional view showing the cover member of the developing cartridge of FIG. 11 and the voltage generating circuit.

In FIG. 11, a power source E is arranged in a main body of the image forming apparatus and is connected to the developing sleeve 1 and the toner supply roller 3 via the interior of the developing apparatus 4 constructed by the developing cartridge and an unillustrated power supply portion. A developing bias applied to the developing sleeve 1 at the time of a developing operation is set in the power source E. In the developing bias, Vdc=−300 V is superposed on an alternating current voltage of a rectangular wave of Vpp=1800 V and frequency f=2000 Hz. Namely, the AC voltage of an effective value −300 V is applied to the developing sleeve 1.

A toner charging bias is branched from the developing bias within the voltage generating circuit 18 within the developing apparatus 4 and is applied to the toner charging roller 11. In the charging bias, Vdc=−950 V is superposed on an alternating current voltage of a rectangular wave of Vpp=600 V and frequency f=2000 Hz. Namely, the AC voltage of an effective value −950 V is applied to the toner charging roller 11.

A blade bias is branched from the charging bias within the voltage generating circuit 18 and is applied to the developing blade 2.

FIG. 12 is a perspective view showing the structure of connecting portions of the voltage generating circuit within the cover member 34 of the developing cartridge showing features of this embodiment, the toner charging roller 11 and the developing blade 2. Reference numerals 21*a* to 21*c* designate bias supply metal plates. A bias receiving portion 21*a* receives a developing bias from a bias contact portion on an unillustrated main body side of the image forming apparatus. The developing bias is supplied to the developing sleeve 1 by a developing sleeve contact portion 21*b*. Further, the developing bias is supplied to the toner supply roller 3 by a toner supply roller contact portion 21*c*.

In contrast to this, a bias branching metal plate 22 comes in contact with bias supply metal plate 21*b* in a metal plate contact portion 22*a* and receives a bias voltage and this bias voltage is supplied to the voltage generating circuit 18. The voltage generating circuit 18 is connected to an unillustrated earth contact portion by an earth connection metal plate 23. The voltage generating circuit 18 is also connected by a voltage supply metal plate 24 to an unillustrated spring contact member attached to a tip of a connection metal plate 26 attached to a bearing member 25 of the developing sleeve. A bias voltage received by the spring contact member is transmitted to the connection metal plate 26 and is also transmitted to a roller bias connection metal plate 28 by a spring connection member 27 and is supplied to the toner charging roller 11.

In FIG. 13, a diode 29, capacitors 30, 31 and resistors 32, 33 are used as electric elements in the voltage generating circuit 18. These electric elements are received by a receiving portion arranged integrally with the cover member 34, and are pressed and held by the bias branching metal plate 22, the sleeve bias supply metal plate 24, the earth connection metal plate 23 and a blade connection metal plate 35. The respective metal plates are attached to the cover member 34 by a method of thermal caulking, etc. Here, a blade contact metal plate 36 comes in contact with the blade connection metal plate 35 and a contact portion 36*a* and a blade pressing metal plate 20 are connected to each other as shown in FIG. 12, and the bias voltage is applied to the developing blade 2.

In accordance with this embodiment, an electric circuit for dividing the developing bias supplied from the power supply portion to the developing sleeve and supplying the blade bias to the developing blade is arranged within the cover member covering one side of both ends of the developing apparatus in its longitudinal direction. Accordingly, the bias voltage can be applied to the developing sleeve 1 and the developing blade 2 without increasing the number of high voltage contacts. The nonuniform accumulation of one-component toner in the longitudinal direction, etc. are prevented in an abutting nip portion of the developing blade and the developing sleeve. The toner thin layer of a uniform thickness can be stably formed on the developing sleeve and a latent image on the photosensitive drum can be preferably developed. Further, since the number of contacts is not increased, it is not necessary to arrange an area for new contacts so that this construction does not prevent the apparatus from being made compact.

As explained above, according to the embodiments of the present invention, the accumulation of toner in the longitudinal direction is prevented in the vicinity of an abutting portion of a developer bearing member and a developer regulating member even when fine powder charged in a polarity reverse to that of the toner is externally added to this toner. Accordingly, a thin layer of the toner can be stably formed on the developer bearing member and an image of high quality can be obtained by performing a preferable developing operation.

What is claimed is:

1. A developing apparatus comprising:

a developer bearing member for bearing and carrying a nonmagnetic developer;

a layer thickness regulating member for regulating a layer thickness of the developer borne by said developer bearing member;

developing bias applying means for applying an alternating current voltage to said developer bearing member; and regulating member bias applying means for applying a direct current voltage to said layer thickness regulating member:

wherein when DC1 is an effective value of the alternating current voltage applied to said developer bearing member and DC2 is a value of a direct current voltage applied to said layer thickness regulating member, a direct current voltage value DC2 has a polarity, which is reverse to a charging polarity of the developer with respect to the effective value DC1.

2. A developing apparatus according to claim 1, wherein the developer is a nonmagnetic one-component developer.

3. A developing apparatus according to claim 2, wherein a shape factor SF1 of the developer ranges from 100 to 180 and a shape factor SF2 ranges from 100 to 140.

4. A developing apparatus according to claim 3, wherein the developer has toner and powder charged in a polarity reverse to that of the toner.

5. A developing apparatus according to claim 4, wherein the powder is a metallic oxide.

6. A developing apparatus comprising:

a developer bearing member for bearing and carrying a nonmagnetic developer;

a layer thickness regulating member for regulating a layer thickness of the developer borne by said developer bearing member;

developing bias applying means for applying a direct current voltage to said developer bearing member; and regulating member bias applying means for applying an alternating current voltage to said layer thickness regulating member;

wherein when DC1 is a value of the direct current voltage applied to said developer bearing member and DC2 is an effective value of the alternating current voltage applied to said layer thickness regulating member, the effective value DC2 has a polarity, which is reverse to a charging polarity of the developer with respect to the direct current voltage value of DC1.

7. A developing apparatus according to claim 6, wherein the developer is a nonmagnetic one-component developer.

8. A developing apparatus according to claim 7, wherein a shape factor SF1 of the developer ranges from 100 to 180 and a shape factor SF2 ranges from 100 to 140.

9. A developing apparatus according to claim 8, wherein the developer has toner and powder charged in a polarity reverse to that of the toner.

10. A developing apparatus according to claim 9, wherein the powder is a metallic oxide.

11. A developing apparatus detachably attachable to a main body of an image forming apparatus, comprising:

a developing apparatus side contact connected to an apparatus side contact of the main body of the image forming apparatus when the developing apparatus is mounted to the apparatus main body;

a developer bearing member for bearing and carrying a nonmagnetic developer, wherein a bias voltage can be applied to said developer bearing member by connecting said developing apparatus side contact to said apparatus side contact;

a layer thickness regulating member for regulating a layer thickness of the developer borne by said developer bearing member, wherein the bias voltage can be applied to said layer thickness regulating member by connecting said developing apparatus side contact to said apparatus side contact; and an electric circuit for dividing a voltage applied to said developer bearing member or a voltage applied to said layer thickness regulating member from a voltage applied to said developing apparatus through said developing apparatus side contact when said developing apparatus is mounted to said image forming apparatus main body.

12. A developing apparatus according to claim 11, wherein the developer is a nonmagnetic one-component developer.

13. A developing apparatus according to claim 12, wherein a shape factor SF1 of the developer ranges from 100 to 180 and a shape factor SF2 ranges from 100 to 140.

14. A developing apparatus according to claim 13, wherein the developer has toner and powder charged in a polarity reverse to that of the toner.

15. A developing apparatus according to claim 14, wherein the powder is a metallic oxide.

16. A developing apparatus according to claim 11, wherein said developing apparatus is detachably attached to said apparatus main body together with an image bearing member for bearing a latent image.

17. A developing apparatus detachably attachable to a main body of an image forming apparatus, comprising:

a developing apparatus side contact connected to an apparatus side contact of the main body of the image forming apparatus when the developing apparatus is mounted to the apparatus main body;

a developer bearing member for bearing and carrying a nonmagnetic developer, wherein a bias voltage can be applied to said developer bearing member by connecting said developing apparatus side contact to said apparatus side contact; and a layer thickness regulating member for regulating a layer thickness of the developer borne by said developer bearing member, wherein the bias voltage can be applied to said layer thickness regulating member by connecting said developing apparatus side contact to said apparatus side contact, and a cover provided on one end side of said developing apparatus in a longitudinal direction thereof, wherein said developing apparatus side contact is provided outside the cover, and an electric circuit for dividing a voltage applied to said developer bearing member and a voltage applied to said layer thickness regulating member is provided inside the cover.

* * * * *

UNITED STATES PATENT AND TRADEMARK OFFICE

CERTIFICATE OF CORRECTION

PATENT NO. : 6,415,127 B1
DATED : July 2, 2002
INVENTOR(S) : Shinya Yamamoto et al.

It is certified that error appears in the above-identified patent and that said Letters Patent is hereby corrected as shown below:

Column 13,
Line 32, “The” should read -- the --.

Column 14,
Line 34, “stainless,” should read -- stainless steel, --; and
Line 47, “by” should read -- of --.

Column 15,
Line 21, “until an endurance life.” should read -- until an end of its service life. --.

Column 18,
Line 20, “are” should read -- is --.

Signed and Sealed this

Eleventh Day of February, 2003

JAMES E. ROGAN
*Director of the United States Patent and Trademark Office*